US010822867B2

(12) United States Patent
Walling

(10) Patent No.: US 10,822,867 B2
(45) Date of Patent: Nov. 3, 2020

(54) PRE-FRAMED COLLAPSIBLE IN WALL GATE

(71) Applicant: Hideagate, LLC, Double Oak, TX (US)

(72) Inventor: Andrew Peter Walling, Double Oak, TX (US)

(73) Assignee: Hideagate, LLC, Double Oak, TX (US)

( * ) Notice: Subject to any disclaimer, the term of this patent is extended or adjusted under 35 U.S.C. 154(b) by 0 days.

(21) Appl. No.: 16/051,135

(22) Filed: Jul. 31, 2018

(65) Prior Publication Data

US 2018/0334849 A1 Nov. 22, 2018

Related U.S. Application Data

(63) Continuation-in-part of application No. 15/595,372, filed on May 15, 2017.

(60) Provisional application No. 62/336,188, filed on May 13, 2016.

(51) Int. Cl.

| | |
|---|---|
| ***E06B 11/02*** | (2006.01) |
| ***E06B 9/00*** | (2006.01) |
| ***E06B 9/06*** | (2006.01) |
| ***E06B 9/04*** | (2006.01) |

(52) U.S. Cl.

CPC ..... *E06B 9/0653* (2013.01); *E06B 9/04* (2013.01); *E06B 9/0615* (2013.01); *E06B 9/0623* (2013.01); *E06B 9/0676* (2013.01); *E06B 2009/002* (2013.01)

(58) Field of Classification Search

CPC ..... E06B 9/0623; E06B 9/0661; E06B 11/02; E06B 11/023; E06B 9/0653; E06B 9/04; E06B 9/0615; E06B 9/0676; E06B 2009/002

See application file for complete search history.

(56) References Cited

U.S. PATENT DOCUMENTS 742,217 A * 10/1903 Nielsen ..... E05F 11/04 160/143
924,067 A * 6/1909 Heston ..... E05F 11/04 160/143
1,091,652 A * 3/1914 Hall ..... E06B 9/0623 160/160
1,354,320 A * 9/1920 McCallum ..... E05F 13/04 160/4
1,407,062 A * 2/1922 Griffin ..... C04B 28/10 160/148

(Continued)

*Primary Examiner* — Kimberley S Wright
(74) *Attorney, Agent, or Firm* — Shannon W. Bates; Harper Bates & Champion LLP

(57) ABSTRACT

A collapsible gate may provide a temporary barrier to prevent movement between rooms, or to prevent access to a staircase, in a home or commercial building. A pre-framed collapsible gate may be secured to and supported by a framing system for installation within a wall, wherein the collapsible gate is adapted for storage within the framing system when not in use. The pre-framed collapsible gate may be vertically retractable and adapted to stow within a framing system installed within a wall and out of sight. The collapsible gate may include a counterbalance to maintain the gate within the framing system when the gate is in the fully open position, and to assist in opening the gate when the gate is lifted from a closed position.

20 Claims, 19 Drawing Sheets

(56) References Cited

U.S. PATENT DOCUMENTS

| | | | | | |
|---|---|---|---|---|---|
| 1,419,013 | A * | 6/1922 | Burgess | E06B 11/02 | 160/151 |
| 1,819,984 | A * | 8/1931 | Weidlein | E06B 11/02 | 160/4 |
| 2,661,557 | A * | 12/1953 | Alois | E06B 11/02 | 160/144 |
| 6,202,729 | B1 * | 3/2001 | Cunningham | E06B 9/0623 | 160/136 |
| 6,932,141 | B2 * | 8/2005 | Cook | E06B 11/02 | 160/160 |
| 8,713,851 | B2 * | 5/2014 | Flannery | E06B 9/04 | 49/55 |
| 9,151,108 | B1 * | 10/2015 | Flannery | E06B 9/04 | |
| 9,394,726 | B1 * | 7/2016 | Flannery | E06B 9/04 | |
| 9,874,056 | B1 * | 1/2018 | Flannery | E06B 9/04 | |
| 9,982,479 | B1 * | 5/2018 | Flannery | E06B 9/04 | |
| 10,174,543 | B2 * | 1/2019 | Kapavik | E06B 3/4654 | |
| 2005/0150611 | A1 * | 7/2005 | Cook | E06B 11/02 | 160/218 |
| 2011/0175046 | A1 * | 7/2011 | Flannery | E06B 9/04 | 256/73 |
| 2014/0075863 | A1 * | 3/2014 | Laronde | E06B 1/045 | 52/217 |
| 2014/0360680 | A1 * | 12/2014 | Burgin | B61L 29/04 | 160/160 |

* cited by examiner

PRE-FRAMED COLLAPSIBLE IN WALL GATE

CROSS-REFERENCE TO RELATED APPLICATIONS

This application is a continuation-in-part of U.S. patent application Ser. No. 15/595,372, filed May 15, 2017 and entitled "Collapsible In Wall Gate," which claims the benefit of U.S. Provisional Patent Application Ser. No. 62/336,188 filed May 13, 2016, and entitled "Collapsible In Wall Gate," both of which are incorporated herein by reference in their entirety for all purposes.

TECHNICAL FIELD

The present disclosure relates to apparatus and methods for providing temporary barriers in a home or a commercial building, and more particularly, the present disclosure relates to a collapsible gate secured to and supported by a framing system for installation within a wall, and wherein the collapsible gate is adapted for storage within the framing system in the wall when not in use.

BACKGROUND

Collapsible gates may be used to temporarily block one area from another, such as to prevent movement between rooms and/or to prevent access to a staircase in a home or commercial building. Conventional collapsible gates are generally stand-alone devices that a user may move to a desired location and then expand into operation to occupy the width of a hallway or doorway and thereby provide a temporary barrier. When such conventional gates are collapsed to remove the temporary barrier, the stand-alone gate is typically left out in the open, such as leaned against a wall near the area where it will be used again, or the gate may be stored away in a separate location, such as a closet.

SUMMARY

The present disclosure relates to apparatus for providing temporary barriers in a home or a commercial building. In some implementations, the temporary barriers may prevent movement between rooms or prevent access to a staircase.

In some implementations, the apparatus may comprise a collapsible gate secured to framing material within a wall and adapted for storage within a wall cavity when not in use. In other implementations, the apparatus may comprise a collapsible gate secured to and supported by a framing system for installation within a wall, wherein the collapsible gate is adapted for storage within the framing system in the wall when not in use. In some embodiments, the wall cavity may be a pocket door frame.

In some implementations, the collapsible gate may be vertically retractable and adapted to fit within a pocket door wall cavity between two wall framing studs to stow within the wall and out of sight. In other implementations, the framing system of the pre-framed collapsible gate may be sized for installation in a pocket door wall cavity, and the collapsible gate may be vertically retractable to stow within the framing system in the wall and out of sight. The collapsible gate of the present disclosure may be installed during original construction or during a remodel of the home or commercial building.

In some implementations, the collapsible gate may include a counterbalance to maintain the gate within the wall cavity when the gate is in the fully open position, and to assist in opening the gate when the gate is lifted from a closed position.

In some implementations, the collapsible gate may include a support system adapted to secure the collapsible gate to framing material within a wall, and a rail system translatable between an open configuration wherein the collapsible gate is vertically retracted for storage within a wall cavity of the wall and a closed configuration wherein the collapsible gate is extended across a space to provide a temporary barrier. The rail system may be rotationally coupled to the support system to enable translation between the open configuration and the closed configuration. The rail system may include a top rail, a bottom rail, and a plurality of barrier rails pivotally coupled to the top rail and the bottom rail and extending there between. The plurality of barrier rails may be spaced apart and coupled to alternate sides of the top rail and the bottom rail in a staggered fashion. The collapsible gate may also include a counterbalance coupled to the rail system. In some implementations, the support system of the collapsible gate may include a mounting bracket with a support section and mounting flanges, and the support section may be adapted to fit within a wall cavity and to receive the rail system in the open configuration when the collapsible gate is secured to framing material within a wall. The support system of the collapsible gate may include one or more pairs of alignment tabs adapted to spread apart studs in the framing material and guide placement of the support system when the collapsible gate is secured to framing material within a wall. The collapsible gate may include one or more stabilizer plates coupled to the support system to provide structural support and inhibit flexing of the collapsible gate when in the closed position. The support system of the collapsible gate may include a foot adapted to support the bottom of the collapsible gate against a floor in the closed configuration, and the foot may be height adjustable to enable leveling of the rail system. The collapsible gate may include a stop system adapted to engage the rail system when it translates into the open configuration. The stop system may be adjustable to modify the degree of vertical retraction of the rail system in the open configuration. The collapsible gate may include a lock system adapted to enable selective locking and unlocking of the gate in the closed configuration.

In some implementations, a method of providing a temporary barrier includes: securing a collapsible gate to framing material within a wall, and translating the collapsible gate between an open configuration wherein the collapsible gate is vertically retracted for storage within a wall cavity of the wall and a closed configuration wherein the collapsible gate is extended across a space to provide the temporary barrier. The method may further include engaging a foot of the collapsible gate with a floor when the gate is in the closed configuration, and adjusting a height of the foot to level the collapsible gate with respect to the floor in the closed configuration. The method may further include locking the collapsible gate in the closed configuration. In some implementations, the method may further include modifying the degree of vertical retraction of the collapsible gate in the open configuration.

In other implementations, the pre-framed collapsible gate may include a framing system adapted for installation in a wall, a support system adapted to secure the collapsible gate to the framing system before installation within the wall, and a rail system translatable between an open configuration wherein the collapsible gate is vertically retracted for storage within the framing system within the wall and a closed configuration wherein the collapsible gate is extended across a space to provide a temporary barrier. The framing system may be sized substantially similar to a pocket door frame. The rail system may be rotationally coupled to the support system to enable translation between the open configuration and the closed configuration. The rail system may include a top rail, a bottom rail, and a plurality of barrier rails pivotally coupled to the top rail and the bottom rail and extending there between. The plurality of barrier rails may be spaced apart and coupled to alternate sides of the top rail and the bottom rail in a staggered fashion. The collapsible gate may also include a counterbalance coupled to the rail system. In some implementations, the support system of the collapsible gate may include a mounting bracket with a support section and mounting flanges, and the support section may be adapted to couple to the framing system and to receive the rail system in the open configuration when the pre-framed collapsible gate is installed within a wall. The support system of the collapsible gate may include a foot adapted to support the bottom of the collapsible gate against a floor in the closed configuration, and the foot may be height adjustable to enable leveling of the rail system. The collapsible gate may include a lock system adapted to enable selective locking and unlocking of the gate in the closed configuration.

In some implementations, a method of providing a temporary barrier includes: securing a collapsible gate to a framing system; installing the framing system with secured collapsible gate within a wall, and translating the collapsible gate between an open configuration wherein the collapsible gate is vertically retracted for storage within the framing system in the wall and a closed configuration wherein the collapsible gate is extended across a space to provide the temporary barrier. The method may further include engaging a foot of the collapsible gate with a floor when the gate is in the closed configuration, and adjusting a height of the foot to level the collapsible gate with respect to the floor in the closed configuration. The method may further include locking the collapsible gate in the closed configuration. In some implementations, the method may further include at least partially disposing the collapsible gate within the framing system when the collapsible gate is in the closed configuration and/or coupling the framing system to a framing material within the wall.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure generally provide apparatus for creating a temporary barrier in a home or a commercial building. The temporary barrier may prevent movement between rooms or prevent access to a staircase. The temporary barrier may be a collapsible gate comprising a plurality of different features and components. In one implementation, the collapsible gate may be secured to framing material within a wall and adapted for storage within a wall cavity when not in use. In another implementation, the collapsible gate may be secured to a framing system for installation within a wall, and the collapsible gate may be adapted for storage within the framing system in the wall when not in use. The collapsible gate may be vertically retractable and stowed away within the wall and out of sight. The collapsible gate may be installed during original construction or during a remodel of the home or commercial building.

Figure 1:
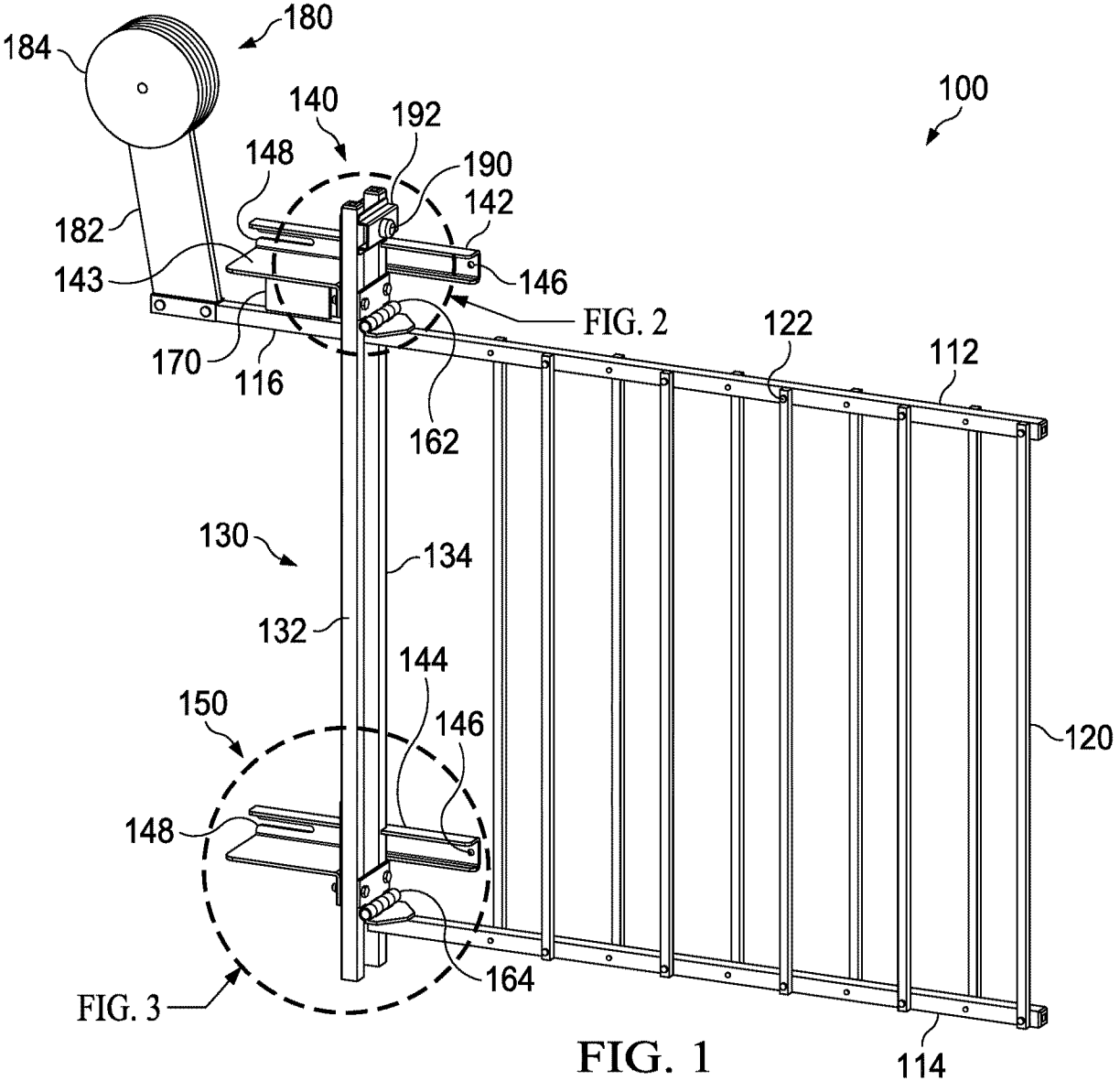
FIG. 1 illustrates a perspective view of an implementation of a collapsible gate according to the present disclosure.
Figure 3:
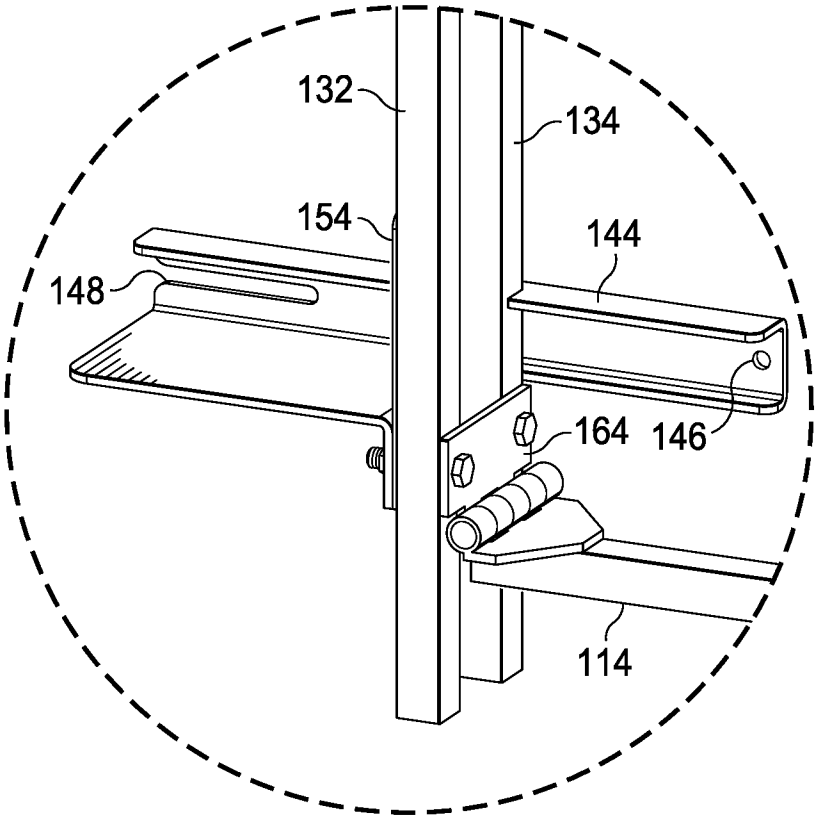
FIG. 3 illustrates an exploded detailed view of another portion of the collapsible gate of FIG. 1.
Figure 2:
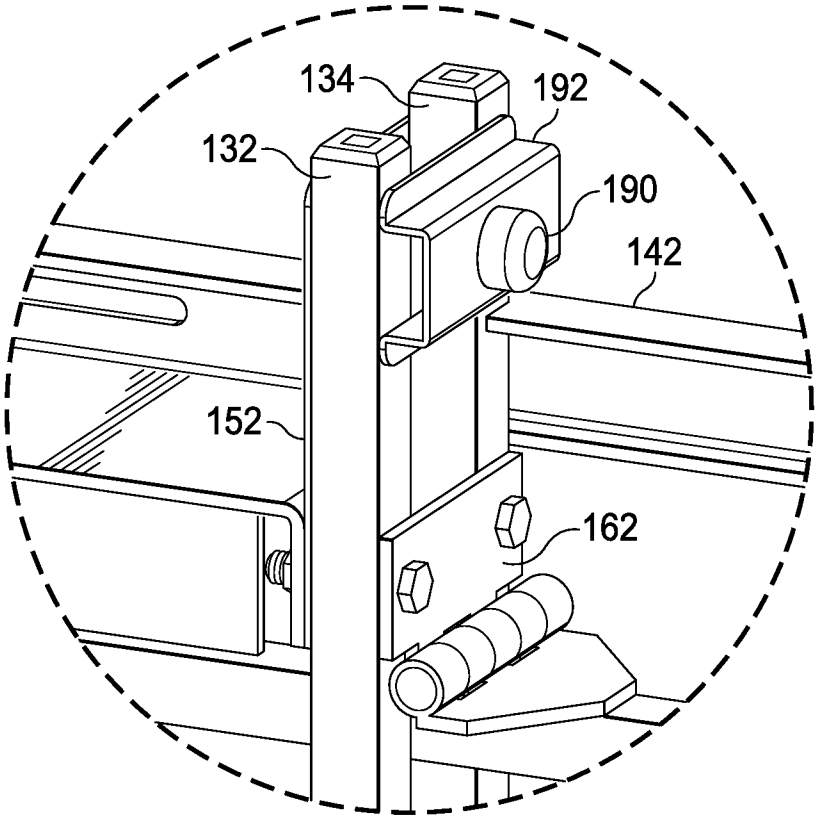
FIG. 2 illustrates an exploded detailed view of a portion of the collapsible gate of FIG. 1.
Figure 4:
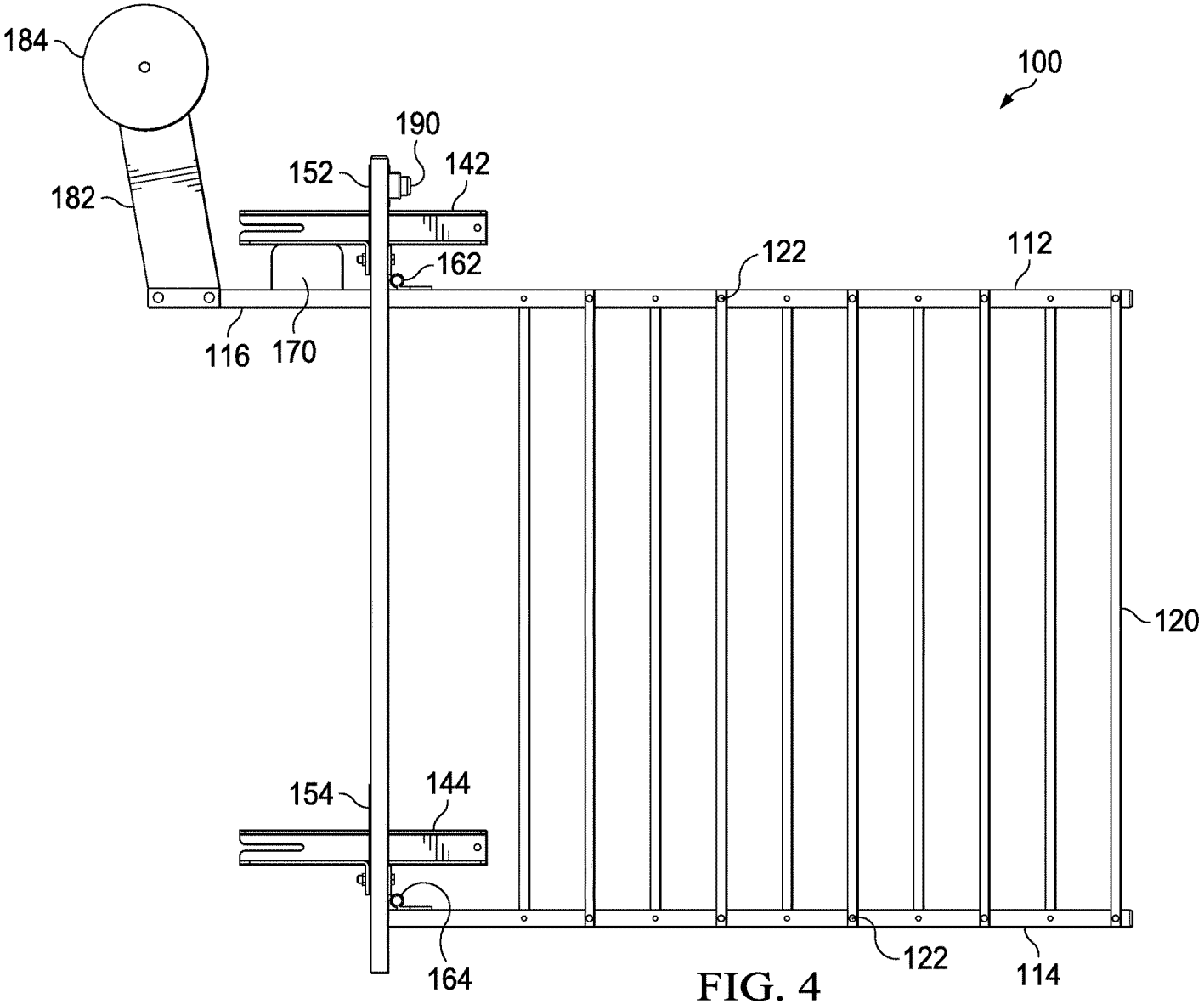
FIG. 4 illustrates a side plan view of the collapsible gate of FIG. 1.
Figure 6:
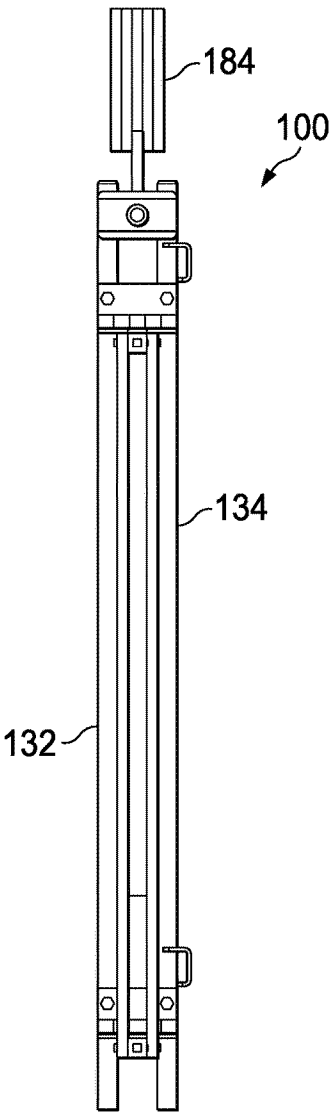
FIG. 6 illustrates an end plan view of the collapsible gate of FIG. 1.
Figure 5:
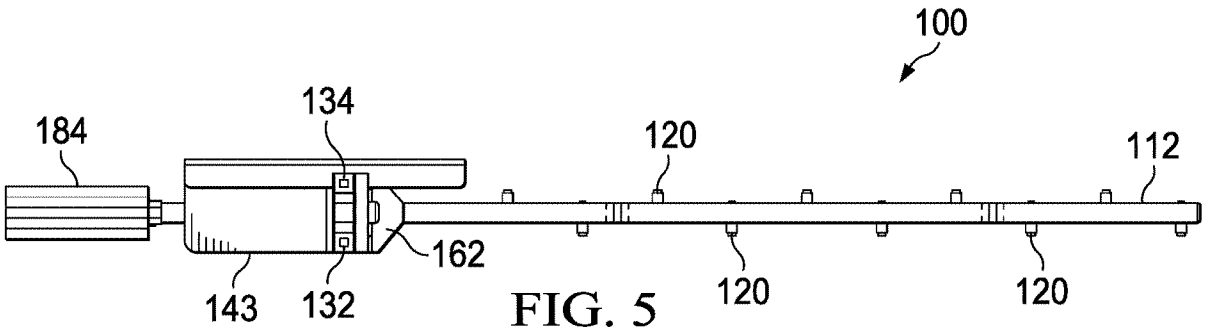
FIG. 5 illustrates a top plan view of the collapsible gate of FIG. 1.

FIGS. 1-7 illustrate various views of an implementation of a collapsible gate 100, according to the present disclosure. In particular, FIG. 1 depicts a perspective view, FIG. 4 depicts a side plan view, FIG. 5 depicts a top plan view, and FIG. 6 depicts an end plan view of the collapsible gate 100. FIGS. 2 and 3 depict exploded detailed views of certain portions of FIG. 1.

The collapsible gate 100 is operable to expand across a hallway or doorway to provide a temporary barrier that may be used, for example, to keep pets or children out of an area. The collapsible gate 100 may comprise a top rail 112, a bottom rail 114 and a plurality of barrier rails 120 extending there between. In an implementation, the top rail 112 and the bottom 114 rail are 1-inch square tubing, and the barrier rails 120 are ½-inch square tubing. In an implementation, a plug is inserted into the open end of each rail 112, 114, 120. The rails 112, 114, 120 may be powder coated steel rails.

Figure 12:
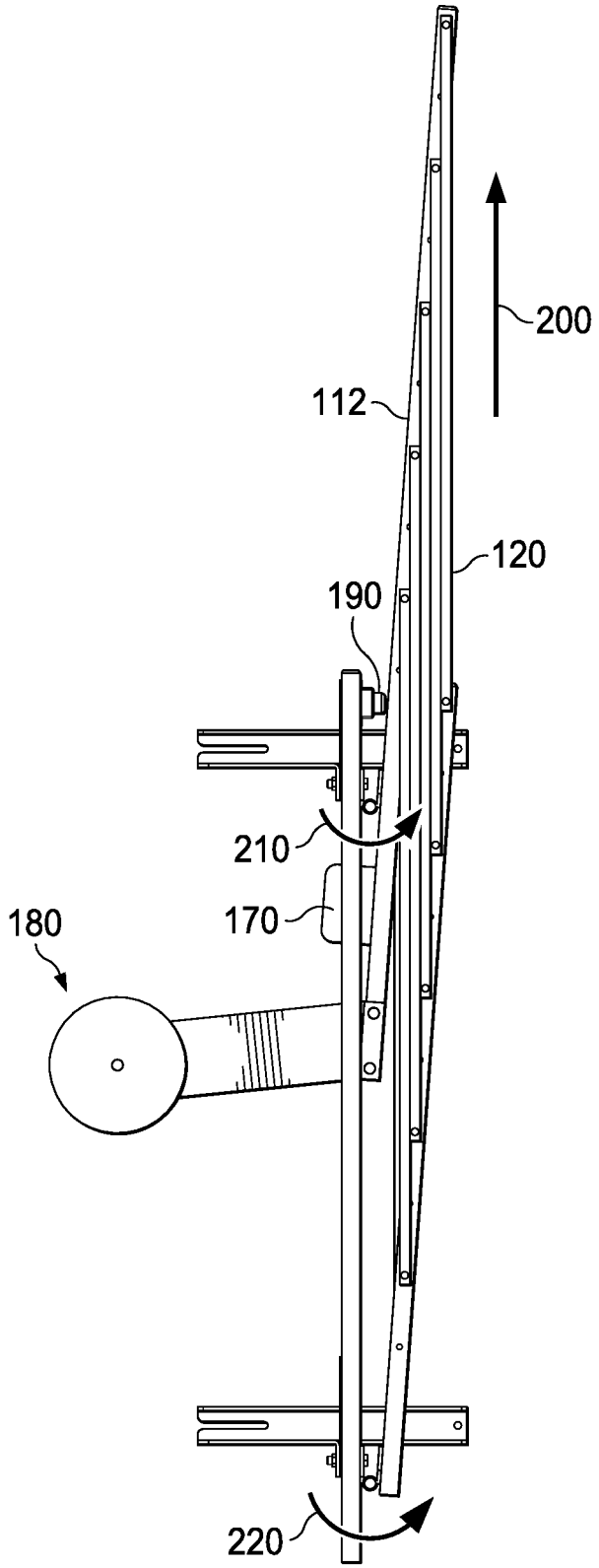
FIG. 12 illustrates a side plan view of the collapsible gate of FIG. 1 in a fully open position.
Figure 13:
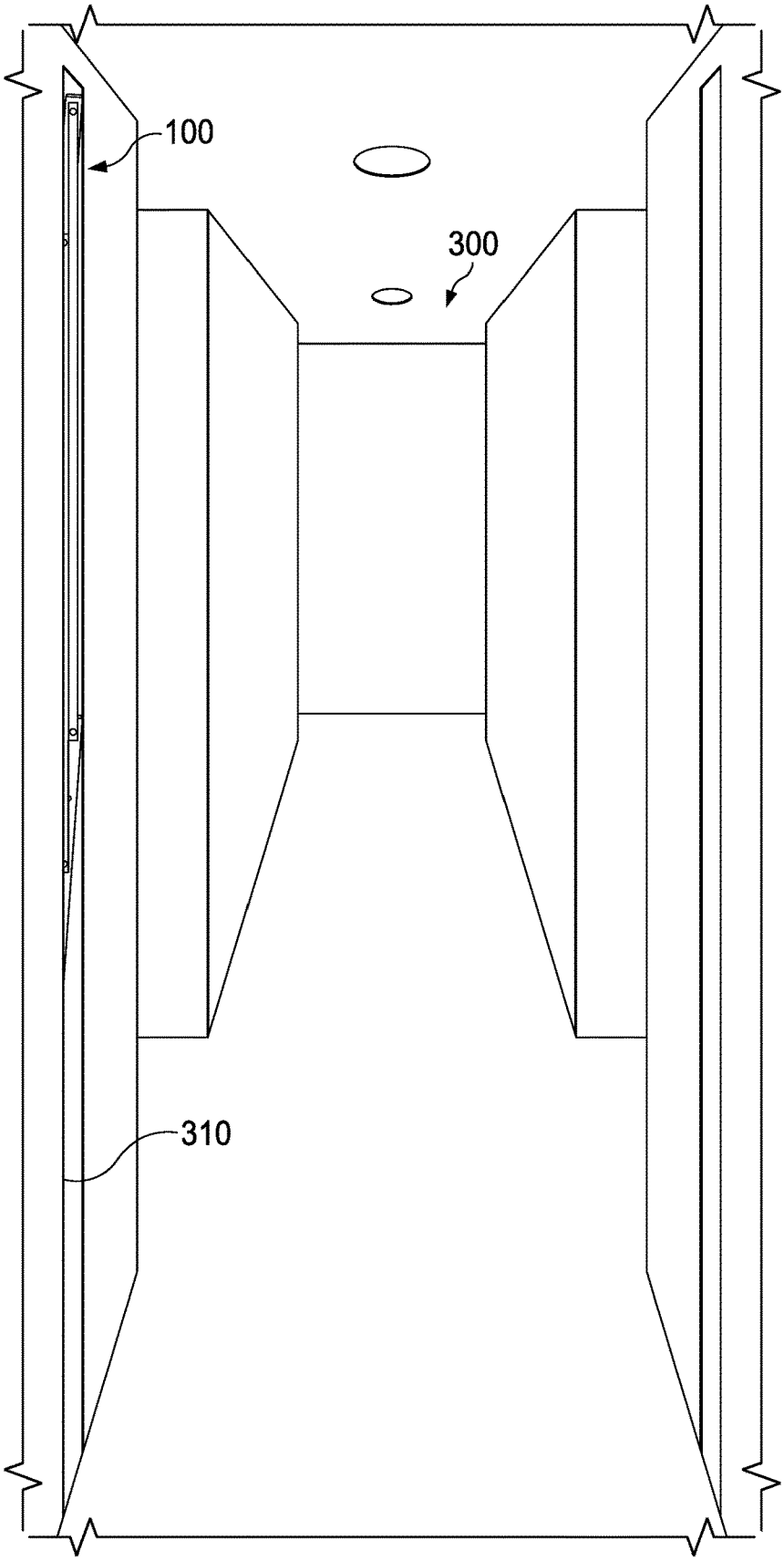
FIG. 13 illustrates the collapsible gate of FIG. 1, secured to framing within a wall cavity in a hallway of a home, and positioned in the fully open position shown in FIG. 12 where the collapsible gate is shown stowed away within the wall cavity.

The ends of each barrier rail 120 may be coupled to the top rail 112 and to the bottom rail 114, respectively, by a fastening assembly 122 that allows relative rotation of the barrier rails 120 with respect to top and bottom rails 112, 114 as the collapsible gate 100 is moved from the closed position shown in FIGS. 1-7 to an open position, shown in FIGS. 12 and 13 and described in more detail herein. As best depicted in FIG. 5, the barrier rails 120 may be coupled to alternate sides of the top rail 112 and the bottom rail 114 in a staggered fashion to allow the gate 100 to collapse tightly in the open position. In an implementation, the fastening assembly 122 comprises a shoulder bolt and a press nut.

The collapsible gate 100 may further comprise a support system including support bars 130, wall mount brackets 140, stabilizer plates 150, and hinges 160. The support system couples the collapsible gate 100 to framing materials within a wall cavity and supports the weight of top rail 112, bottom rail 114 and barrier rails 120 during operation.

In an implementation, the support system comprises a first support bar 132, a second support bar 134, an upper wall mount bracket 142, a lower wall mount bracket 144, an upper stabilizer plate 152, a lower stabilizer plate 154, an upper hinge 162 and a lower hinge 164.

In an implementation, the support bars 130 are 1-inch square tubing approximately 48-inches long, and a plug is inserted into the open ends of support bars 132, 134. The support bars 130 may be powder coated steel bars.

The top rail 112 may pivotally couple to the first and second support bars 130, 132 via upper hinge 162, and the bottom rail 114 may pivotally couple to the first and second support bars 130, 132 via lower hinge 164, thereby coupling the rails 112, 114, 120 to the support system. FIG. 3 depicts an exploded detailed view of the lower hinge 164 pivotally coupling the bottom rail 114 to the support bars 130, 132.

The first and second support bars 132, 134 may be coupled together in two locations by upper and lower stabilizer plates 152, 154. In various implementations, the stabilizer plates 152, 154 may be vertically disposed and welded or fastened to the first and second support bars 132, 134 to fixedly connect the support bars 130 together and provide additional structural support.

The upper stabilizer plate 152 may further couple to the upper wall mount bracket 142 and the lower stabilizer plate 154 may further couple to the lower wall mount bracket 144, thereby coupling the support bars 130 to the wall mount brackets 140. In various implementations, the stabilizer plates 150 may be welded or fastened to the wall mount brackets 140 to fixedly connect the support bars 130 to the wall mount brackets 140.

The second support bar 134 may further couple to the upper wall mount bracket 142 and to the lower wall mount bracket 144, thereby coupling the support bars 130 to the wall mount brackets 140 in another manner. In various implementations, the second support bar 134 may be welded or fastened to the wall mount brackets 140 to fixedly connect the support bars 130 to the wall mount brackets 140 in another manner.

The wall mount brackets 140 are operable to secure the collapsible gate 100 to framing material within a wall cavity of a home or commercial building. Each of the upper and lower wall mount brackets 142, 144 may include a bolt hole 146 on one end and a bolt slot 148 on the other end. The bolt holes 146 and the bolt slots 148 are adapted to receive fasteners, such as lag bolts, for mounting the collapsible gate 100 to the framing material. The bolt slots 148 allow for install adjustments in the mounting location, which will depend upon the width of the hallway or doorway the collapsible gate 100 will occupy in the closed position.

The collapsible gate 100 may further comprise a stop system designed to inhibit damage to components of the collapsible gate 100 as the gate 100 reaches the closed position shown in FIGS. 1-7 and as the gate 100 reaches the fully open position shown in FIG. 12, as described in more detail herein. In an implementation, the stop system comprises a posi-stop component 170 and a bumper 190.

The posi-stop component 170 may be coupled to a rail extension 116 of the top rail 112 that extends beyond the support bars 130. In various implementations, the posi-stop component 170 may be welded or fastened to the rail extension 116. As best shown in FIG. 1, in the closed position of the collapsible gate 100, the posi-stop component 170 engages a flange 143 extending horizontally from the upper wall mounting bracket 142. As the collapsible gate 100 moves from an open position to the closed position shown in FIG. 1, the posi-stop component 170 moves into engagement with flange 143, thereby providing a stopping point for translation of the collapsible gate once it reaches the fully closed position shown in FIGS. 1-7 where the top rail 112 and the bottom rail 114 are each disposed at approximately a 90-degree angle to the support bars 130. The engagement between the posi-stop component 170 and the flange 143 also provides support to the collapsible gate 100 in the closed position if a downward force is exerted on the gate 100 in the closed position, such as if children climb on the gate 100.

The bumper 190 may be coupled to an upper region of the support bars 130 via a bumper plate 192, as best shown in exploded detailed view in FIG. 2. In various implementations, the bumper 190 may be welded, fastened or adhered to the bumper plate 192, and the bumper plate 192 may be welded or fastened to the support bars 130. As best shown in FIG. 12, and described in more detail herein, in the fully open position of the collapsible gate 100, the bumper 190 engages the top rail 112. As the collapsible gate 100 moves from a closed position to the open position shown in FIG. 12, the top rail 112 moves into engagement with the bumper 190, thereby providing a stopping point for translation of the collapsible gate 100 once it reaches the fully open position.

The collapsible gate 100 may further comprise a counterbalance system 180 designed to counter the weight of the rails 112, 114, 120 and securely maintain the collapsible gate 100 in the fully open position of FIG. 12. The counterbalance system 180 also assists in opening the gate 100 as the gate is lifted vertically from the closed position shown in FIG. 1.

In an implementation, the counterbalance system 180 comprises an arm 182 disposed at an angle and supporting at least one plate 184 that adds appropriate weight to the counterbalance system 180 based on the size of the collapsible gate 100. The counterbalance system 180 may be coupled to the rail extension 116 of the top rail 112 that extends beyond the support bars 130. In various implementations, the arm 182 of the counterbalance system 180 may be welded or fastened to the rail extension 116.

FIGS. 7-12 depict various operational positions of the collapsible gate 100 from closed to fully open.

Figure 7:
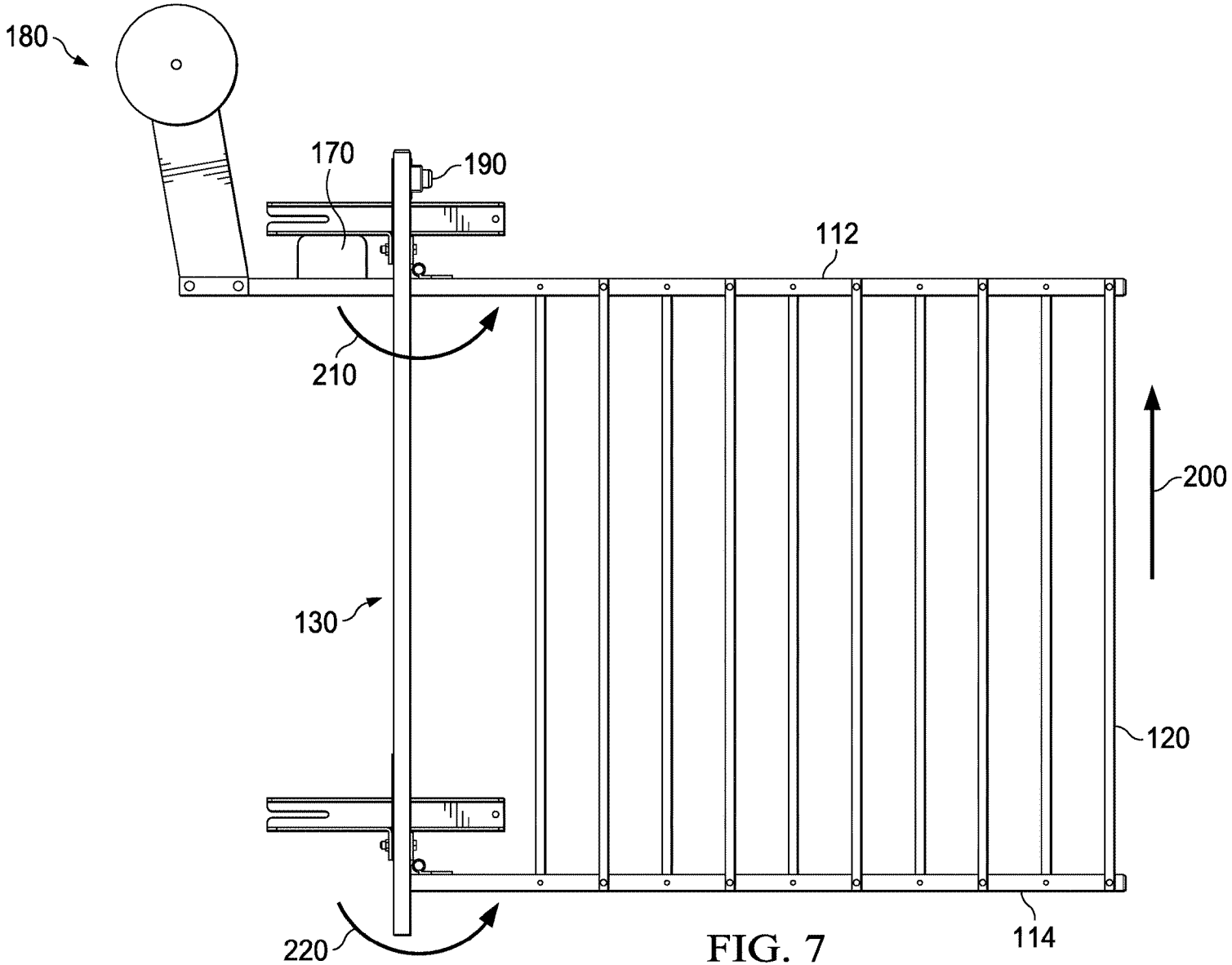
FIG. 7 illustrates a side plan view of the collapsible gate of FIG. 1 in the closed position.

FIG. 7 shows the gate 100 in a closed position, with a vertical arrow 200 pointed in the direction the gate 100 will be lifted to the open position, and with rotational arrows 210, 220 identifying the pivot points at the hinges 160.

Figure 8:
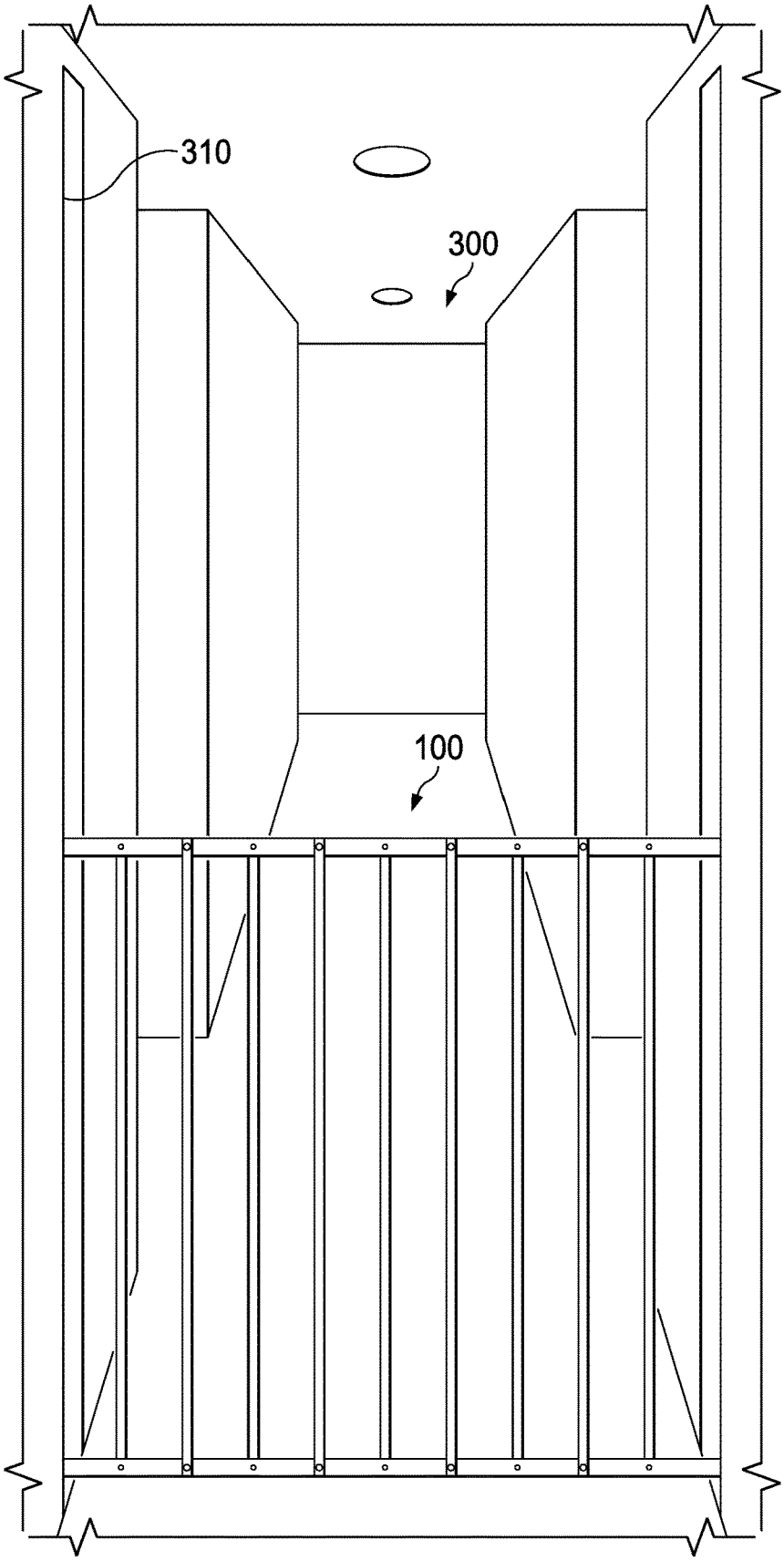
FIG. 8 illustrates the collapsible gate of FIG. 1, secured to framing within a wall cavity in a hallway of a home, and positioned in the closed position shown in FIG. 7 to provide a temporary barrier.

FIG. 8 shows the collapsible gate 100 in the same closed position within a hallway 300 of a home to provide a temporary barrier. Here, the collapsible gate 100 is secured to framing within a wall cavity 310 in the hallway 300. In an implementation, the wall cavity 310 is at least 2-feet wide. In the closed position, all components of the collapsible gate 100 are positioned within the wall cavity 310 except the top rail 112, the bottom rail 114 and the barrier rails 120.

The counterbalance system 180 is not required to maintain the collapsible gate 100 in the closed position shown in FIGS. 7-8. Instead, the weight of the rails 112, 114, 120 will maintain the gate 100 in the closed position. In an implementation, a locking mechanism may be added if the collapsible gate 100 will be used as a temporary barrier for children or pets that learn how to open the gate on their own.

Figure 9:
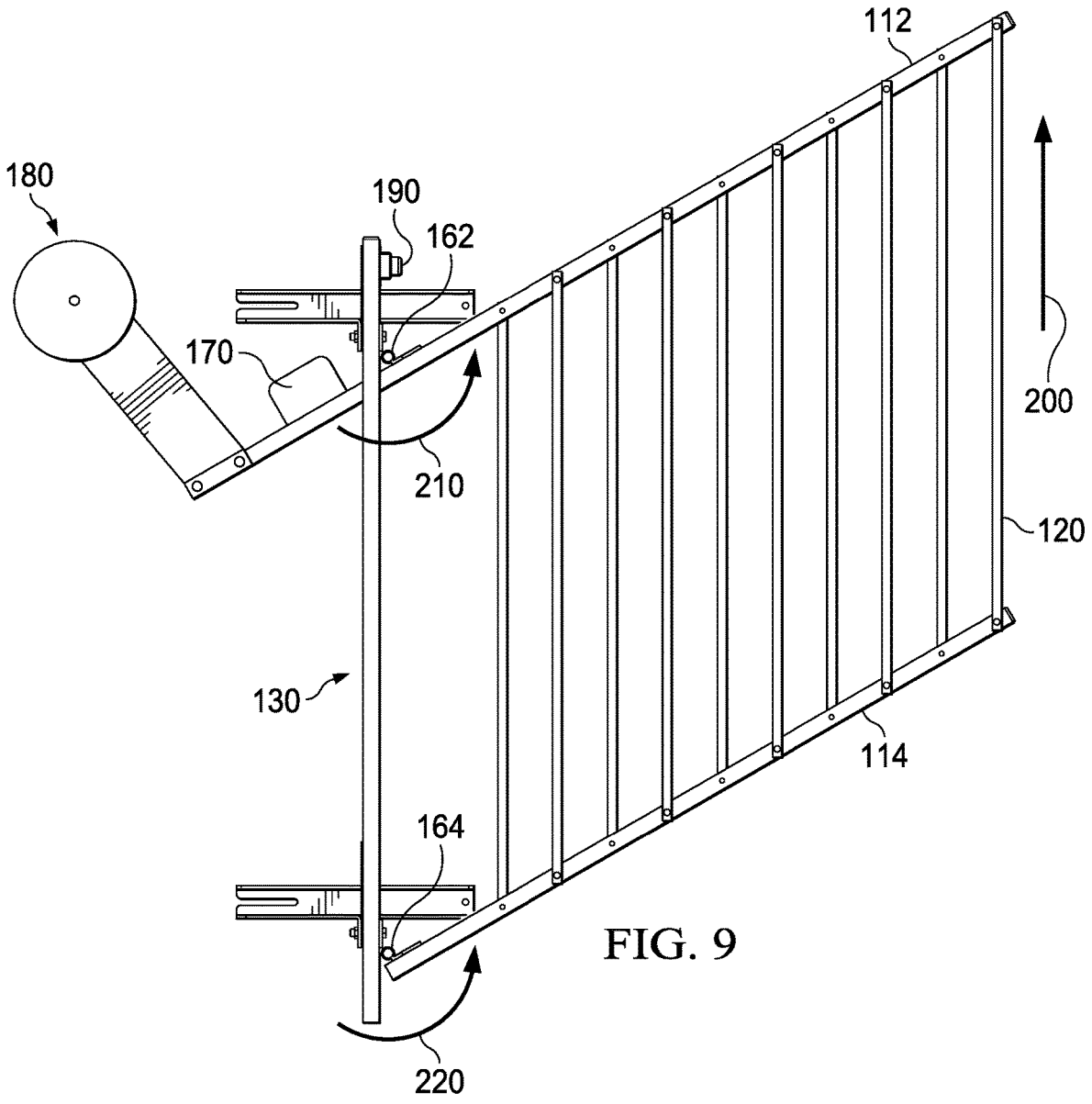
FIG. 9 illustrates a side plan view of the collapsible gate of FIG. 1 in a partially open position, as the gate begins to be lifted vertically.

FIG. 9 illustrates the collapsible gate 100 in a partially open position, as the gate 100 is lifted vertically in the direction of arrow 200. As the gate 100 is moved to the partially open position of FIG. 9, the top rail 112 is pivoted with respect to the support bars 130 by upper hinge 162 as indicated by rotational arrow 210. This pivoting moves the posi-stop component 170 out of engagement with the flange 143 on the upper wall mount bracket 142. The bottom rail 114 is also pivoted with respect to the support bars 130 by lower hinge 164 as indicated by rotational arrow 220. Likewise, the barrier rails 120 are rotated with respect to top and bottom rails 112, 114 as the collapsible gate 100 begins to collapse and retract. The counterbalance system 180 drops downwardly as the front of the gate 100 as lifted upwardly, and the counterbalance system 180 aids in lifting the weight of the rails 112, 114, 120 as the collapsible gate 100 is opened.

Figure 10:
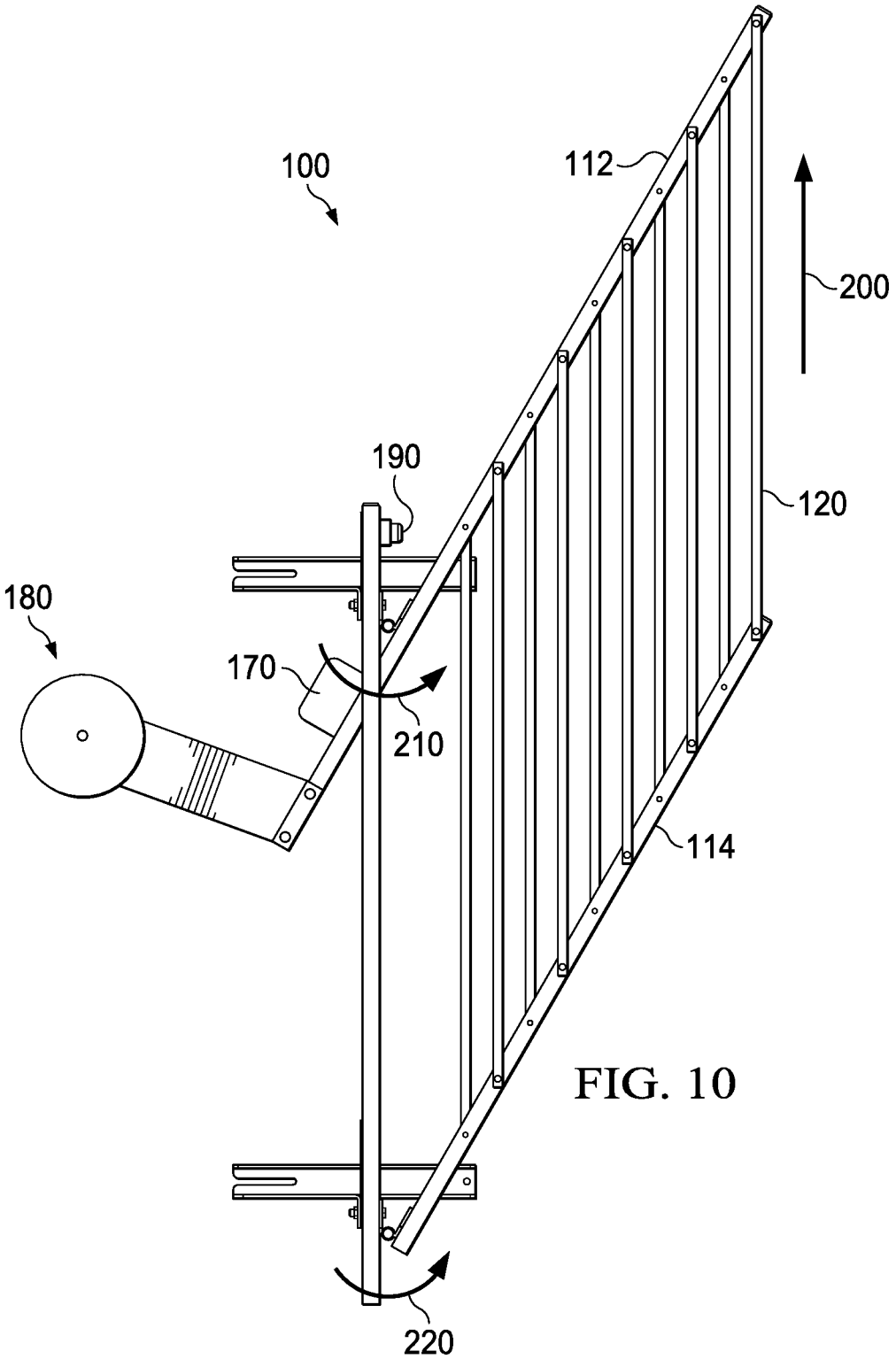
FIG. 10 illustrates a side plan view of the collapsible gate of FIG. 1 in a more fully open position, as the gate continues to be lifted vertically.

FIG. 10 shows the collapsible gate 100 in a more fully open position, as the gate continues to be lifted vertically in the direction of arrow 200.

Figure 11:
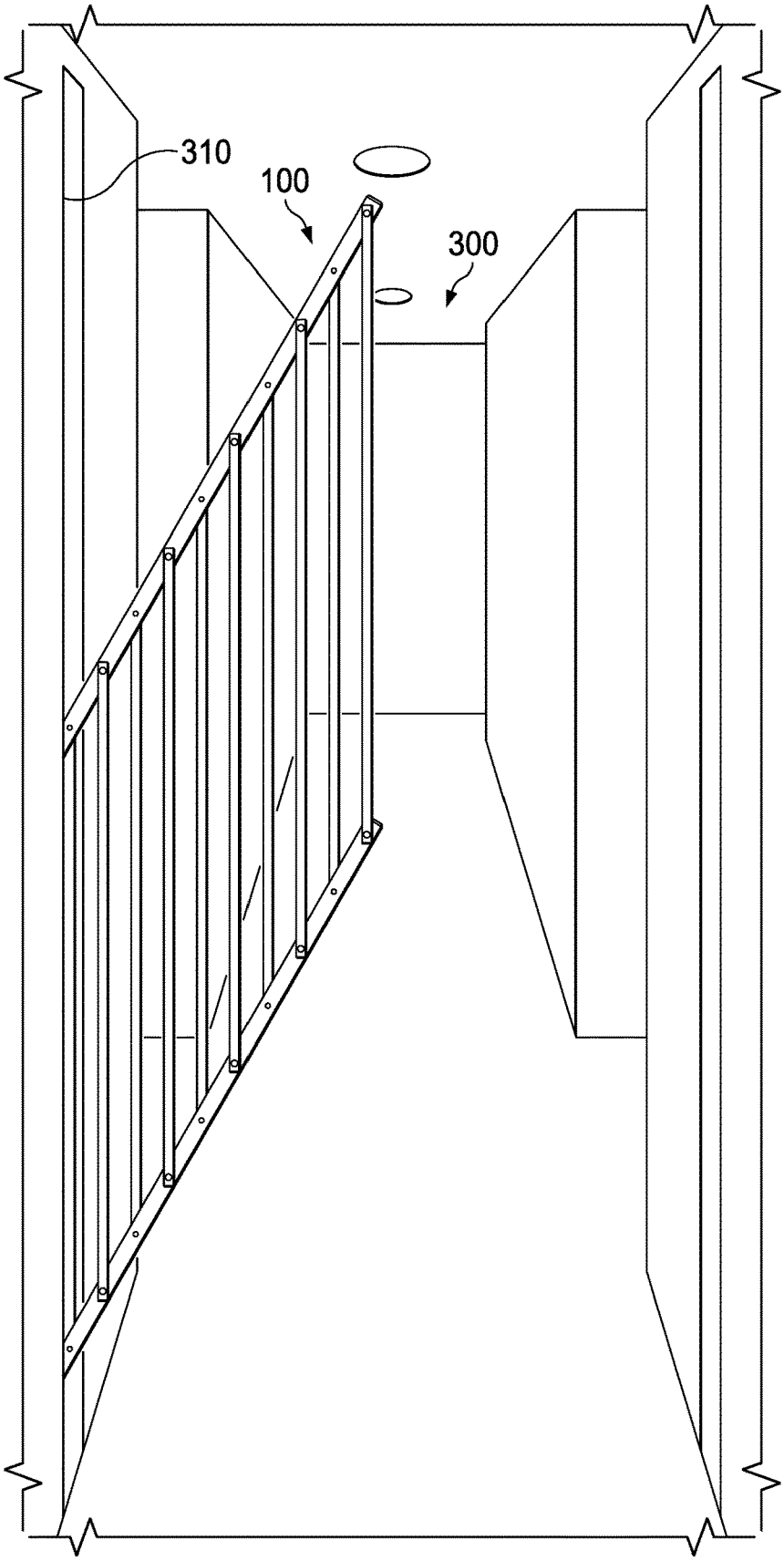
FIG. 11 illustrates the collapsible gate of FIG. 1, secured to framing within a wall cavity in a hallway of a home, and positioned in the more fully open position shown in FIG. 10.

FIG. 11 shows the collapsible gate 100 in the same more fully open position within the hallway 300 of the home. Here, the collapsible gate 100 is retracting into the wall cavity 310 in the hallway 300.

FIG. 12 shows the collapsible gate 100 in a fully open position, with the top rail 112 engaging bumper 190 and thereby acting as a stop.

FIG. 13 shows the collapsible gate 100 in the same fully open position within the hallway 300 of the home. Here, the collapsible gate 100 is fully retracted and stowed within the wall cavity 310, out of sight. In this fully open position, the counterbalance system 180 provides a counterbalancing weight to the rails 112, 114, 120 of the collapsible gate 100. This maintains the gate 100 in the fully open position.

Figure 14:
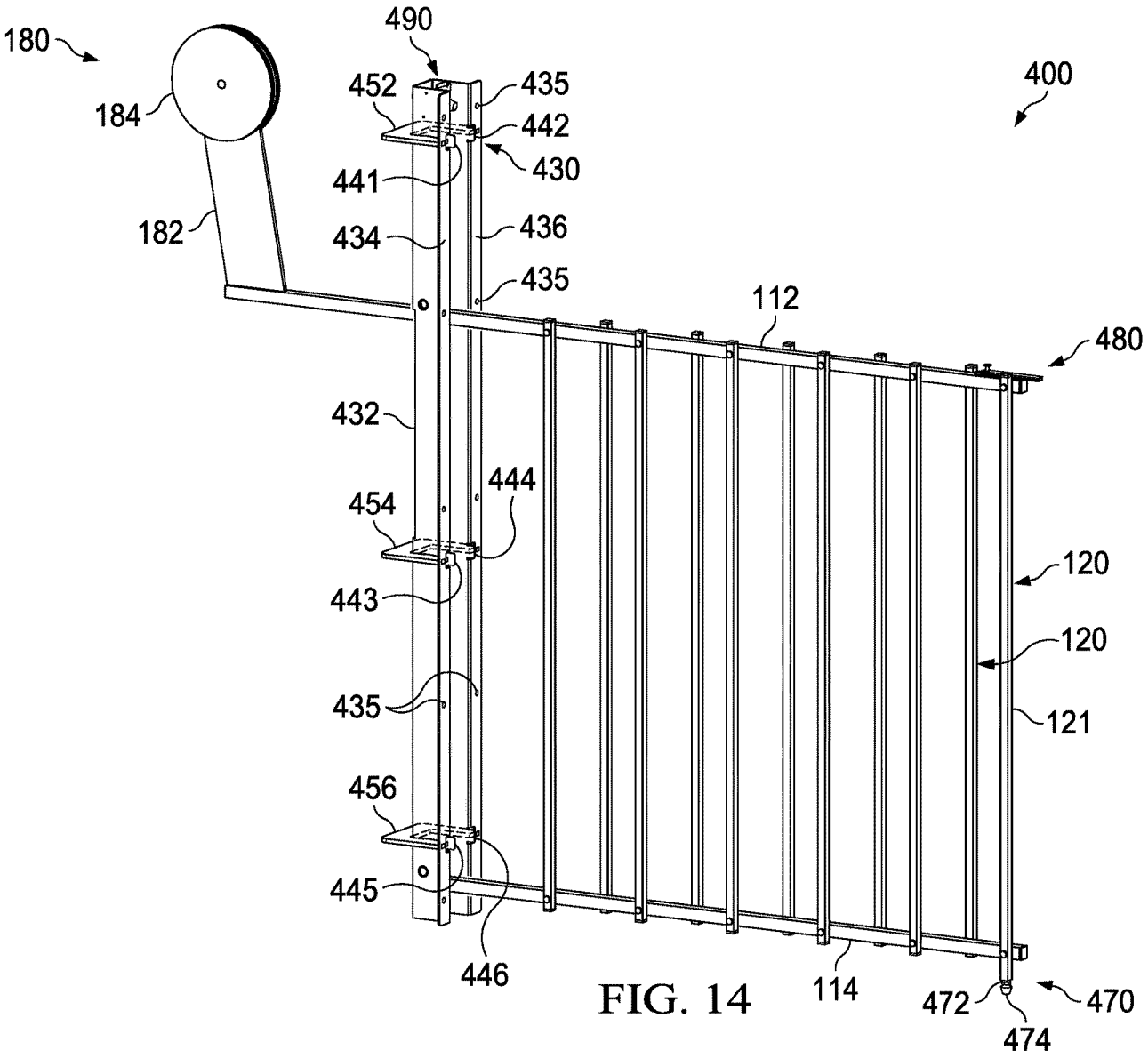
FIG. 14 illustrates a perspective view of another implementation of a collapsible gate according to the present disclosure.
Figure 15:
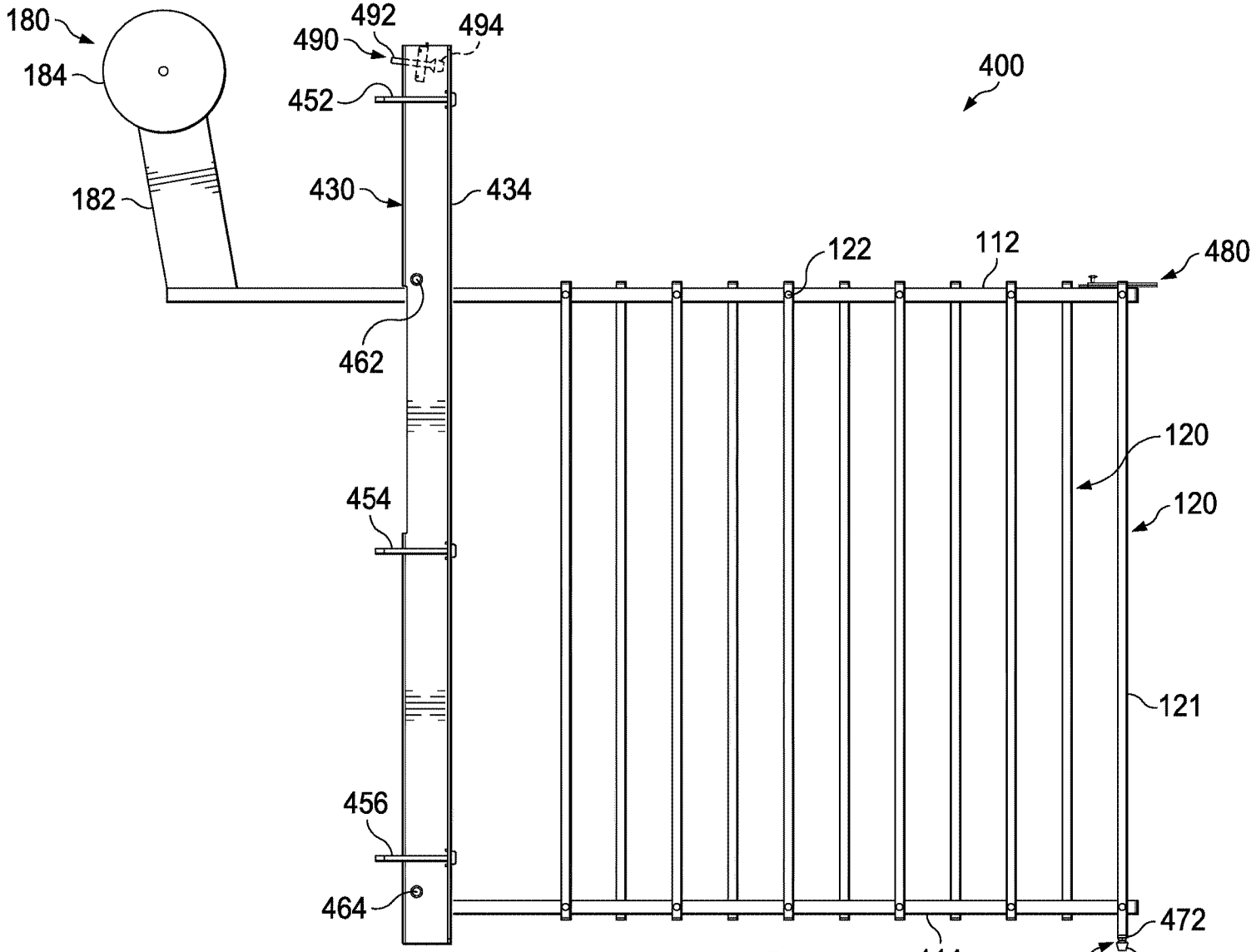
FIG. 15 illustrates a side plan view of the collapsible gate of FIG. 14.
Figure 17:
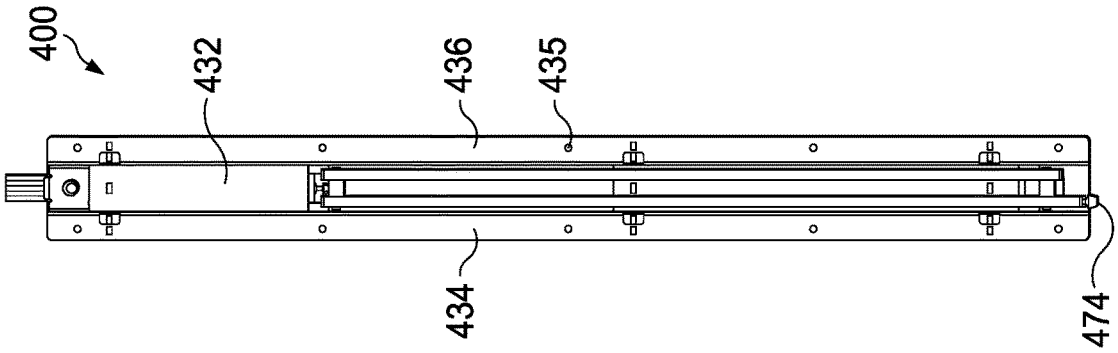
FIG. 17 illustrates an end plan view of the collapsible gate of FIG. 14.
Figure 16:
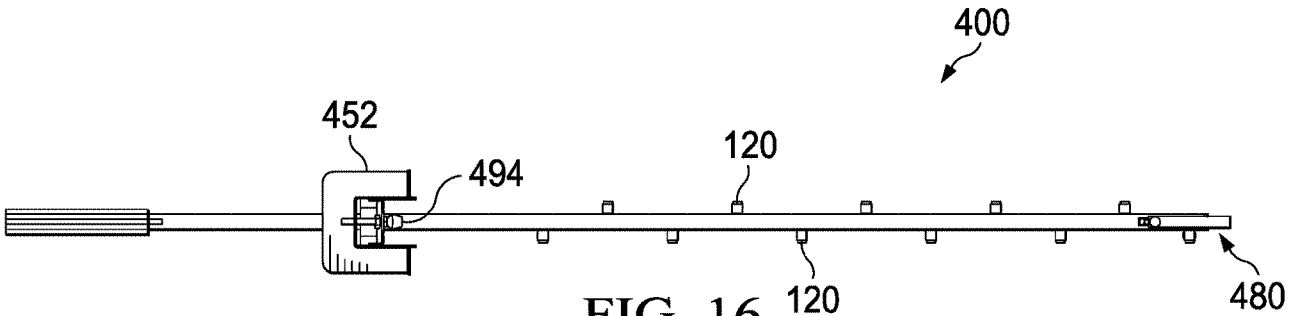
FIG. 16 illustrates a top plan view of the collapsible gate of FIG. 14.

FIGS. 14-17 illustrate various views of another implementation of a collapsible gate 400, according to the present disclosure. In particular, FIG. 14 depicts a perspective view, FIG. 15 depicts a side plan view, FIG. 16 depicts a top plan view, and FIG. 17 depicts an end plan view of the collapsible gate 400. Like reference numerals are used to indicate common features between collapsible gate 400 of FIGS. 14-17 and collapsible gate 100 of FIGS. 1-6.

As with collapsible gate 100, the collapsible gate 400 is operable to expand across a hallway or doorway to provide a temporary barrier that may be used, for example, to keep pets or children out of an area. The collapsible gate 400 may include a top rail 112, a bottom rail 114 and a plurality of barrier rails 120 extending there between. As best depicted in FIGS. 14 and 16, the barrier rails 120 may be coupled to alternate sides of the top rail 112 and the bottom rail 114 in a staggered fashion to allow the gate 400 to collapse tightly in the open position.

The collapsible gate 400 may further comprise a support system including a mounting bracket 430, alignment tabs 440, stabilizer plates 450, hinges 460, and an adjustable foot 470. The support system couples the collapsible gate 400 to framing materials within a wall cavity and supports the weight of top rail 112, bottom rail 114 and barrier rails 120 during operation.

In an implementation, the support system comprises a mounting bracket 430 including a U-shaped support section 432 with a first mounting flange 434 and a second mounting flange 436 coupled thereto. As best depicted in FIGS. 14 and 17, the first mounting flange 434 and the second mounting flange 436 may each extend outwardly from, and perpendicular to, the respective legs of the U-shaped support section 432. In an implementation, the mounting bracket 430 may have a unitary construction formed by bending a single steel plate to create the U-shaped support section 432, the first mounting flange 434, and the second mounting flange 436. In operation, the U-shaped support section 432 fits within a wall cavity and each of the first mounting flange 434 and the second mounting flange 436 includes a plurality of mounting holes 435 to receive screws to mount the collapsible gate 400 to framing material within the wall cavity. When the gate 400 is in the open position, the U-shaped support section 432 receives the top rail 112, bottom rail 114 and the barrier rails 120 of the gate 400 in its collapsed configuration.

As best shown in FIG. 14, the support system further comprises one or more pairs of alignment tabs 440 positioned parallel to the mounting flanges 434, 436 and extending inwardly into the cavity formed by the U-shaped support section 432. These alignment tabs 440 extend into the cavity just enough to keep framing material studs spread apart and otherwise guide placement of the mounting bracket 430 for mounting to the framing material within the wall cavity. In an implementation, alignment tabs 440 comprise a first pair of tabs 441, 442; a second pair of tabs 443, 444; and a third pair of tabs 445, 446 spaced apart along the length of the mounting bracket 430 in locations selected to ensure proper alignment of the collapsible gate 400 during mounting.

The support system may further comprise one or more stabilizer plates 450 coupled to the mounting bracket 430 to provide additional structural support and inhibit flexing of the collapsible gate 400 due to its own weight or from forces applied to the gate 400 either during movement or in the closed position, such as if children or pets climb on the gate 400. In an implementation, the stabilizer plates 450 comprise three C-shaped stabilizer plates 452, 454, 456 spaced apart and coupled to encircle the U-shaped support section 432 at various locations along its length. In an implementation, the C-shaped stabilizer plates 452, 454, 456 are positioned in approximately the same locations along the length of the mounting bracket 430 as the pairs of alignment tabs 440.

The support system may further comprise an upper hinge 462 and a lower hinge 464. The top rail 112 may pivotally couple to the mounting bracket 430 via upper hinge 462, and the bottom rail 114 may pivotally couple to the mounting bracket 430 via lower hinge 464, thereby coupling the rails 112, 114, 120 to the support system.

As best shown in FIGS. 14 and 15, the support system of the collapsible gate 400 may further comprise an adjustable foot 470 that supports the bottom of the collapsible gate 400 against the floor of the home or commercial building when the gate 400 is in the closed position. In an implementation, the first barrier rail 121 is slightly longer than the other barrier rails 120. The first barrier rail 121 may include a threaded port at the bottom end thereof to receive a threaded bolt 472 with a stopper foot 474 that engages the floor.

In operation, the threaded bolt 472 may be turned with respect to the threaded port in the first barrier rail 121 to raise or lower the stopper foot 474. In this manner, the adjustable foot 470 enables adjustability to support the collapsible gate 400 and level the top rail 112 and the bottom rail 114 with respect to the floor. In an implementation, the adjustable foot 470 may be raised or lowered up to 1.5 inches to support and level the collapsible gate 400 with respect to all types of flooring, including concrete, tile, wood, carpet, etc.

As best shown in FIGS. 14 and 15, the collapsible gate 400 may further comprise an adjustable stop system 490 coupled to an upper portion of the mounting bracket 430. The adjustable stop system 490 is designed to prevent damage to the collapsible gate 400 when it reaches the fully open position, and the adjustable stop system 490 further acts as a safety feature. In an implementation, the adjustable stop system 490 comprises a threaded bolt 492 received within a corresponding threaded port in the mounting bracket 430, and a bumper 494 that engages the upper rail 112 of the collapsible gate 400 in the open position.

To position the adjustable stop system 490, the threaded bolt 492 may be turned with respect to the threaded port in the mounting bracket 430 to retract or extend the bumper 494 and thereby adjust its position within the cavity formed by the U-shaped support section 432. In this manner, the adjustable stop system 490 enables adjustability for different depths of wall cavities and/or adjustability for how fully the gate 400 collapses when the gate 400 is in the open configuration.

As the collapsible gate 400 moves from a closed configuration to an open configuration, the top rail 112 moves into engagement with the bumper 494, thereby providing a stopping point for translation of the collapsible gate 400 once it reaches the open configuration. Depending upon the position of the adjustable stop system 490, when the top rail 112 engages the bumper 494, the collapsible gate 400 may fully collapse into the wall cavity such that the barrier rails 120 are in their tightest configuration adjacent to one another, or the collapsible gate 400 may not fully collapse and instead extend slightly beyond the wall cavity such that the barrier rails 120 have some spacing between them. Some users may prefer the latter configuration, which prevents the gate 400 from fully collapsing, to avoid having to put their hand into the wall cavity to expand the gate 400 out into the closed configuration and/or to avoid hand injuries due to the tight spacing of the barrier rails 120 in the fully collapsed position.

The collapsible gate 400 may further comprise a locking system 480 designed to lock the gate 400 in the closed configuration shown in FIG. 8. In an implementation, the locking system 480 may comprise a locking slide bolt designed to slide into engagement with an aperture in a wall opposite from the wall cavity to lock the gate 400, and then slide out of engagement with the aperture in the wall to unlock the gate 400.

The collapsible gate 400 of FIGS. 14-17 operates in much the same manner as the collapsible gate 100 of FIGS. 1-6, such that the operational descriptions of FIGS. 7-13 apply to both implementations of collapsible gates 100, 400. In addition, although certain features have been described with respect to either the collapsible gate 100 or the collapsible gate 400, those features may be included within the other implementation of collapsible gate 100, 400. For example, collapsible gate 100 may include a locking system 480, an adjustable foot 470 and/or an adjustable stop system 490. Other modifications are contemplated by the present disclosure.

FIGS. 18-22 illustrate various views of another implementation of a collapsible gate 400, which is secured within a framing system 500 before installation within a wall, according to the present disclosure. The framing system 500 is adapted to secure and support the collapsible gate 400 within a wall rather than securing the collapsible gate 400 directly to framing material within the wall itself. In one implementation, the framing system 500 has a shape and size substantially similar to a pocket door frame. In one implementation, the framing system 500 is sized for installation within a 2 ft.×4 ft. wall cavity. Once the framing system 500 with the collapsible gate 400 is installed within a wall cavity, the framing system 500 may be secured to framing materials within the wall.

Figure 18:
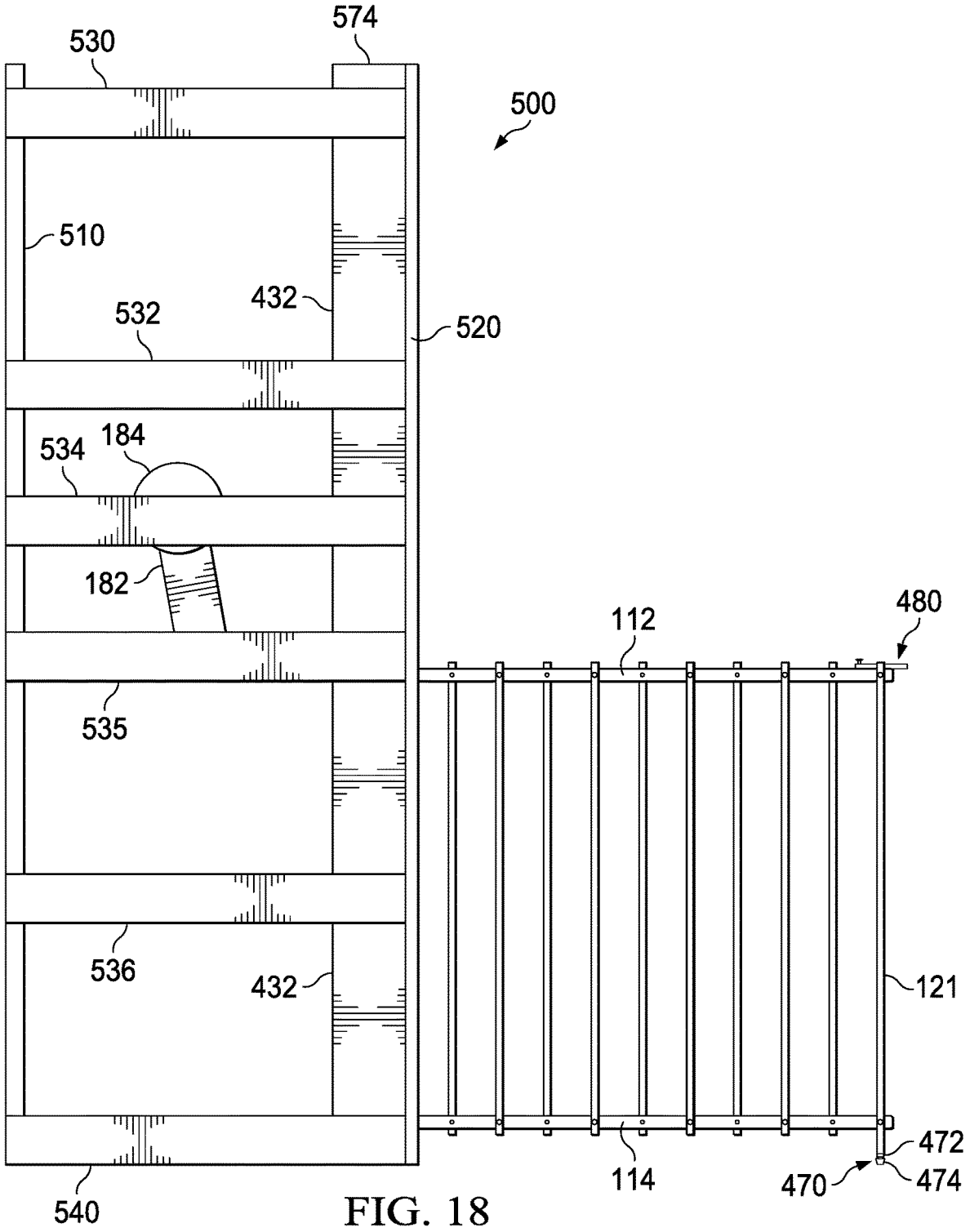
FIG. 18 illustrates a side plan view of an implementation of a pre-framed collapsible gate according to the present disclosure, with the collapsible gate in the closed position.
Figure 19:
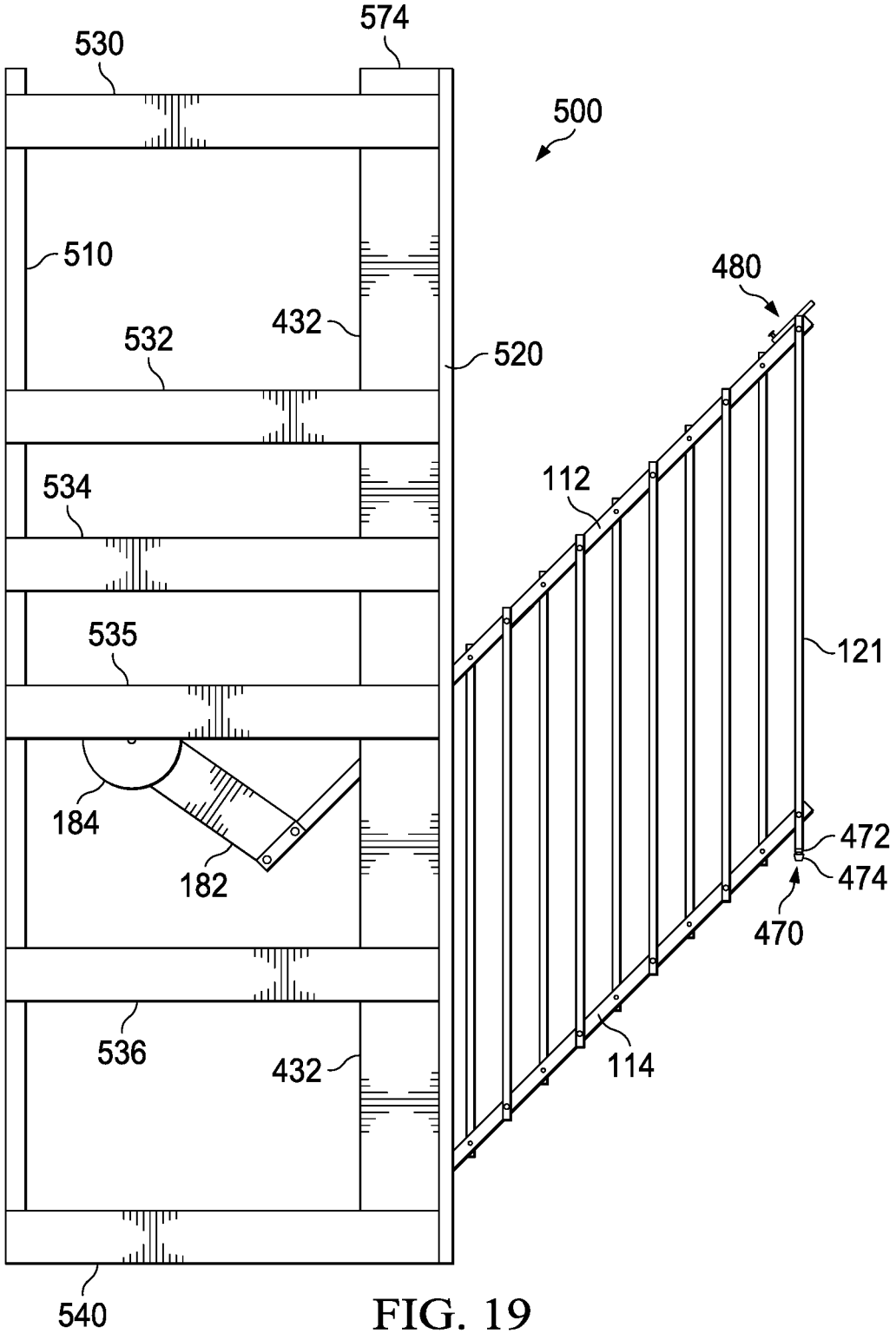
FIG. 19 illustrates a side plan view of the pre-framed collapsible gate of FIG. 18, with the collapsible gate in a partially open position.
Figure 20:
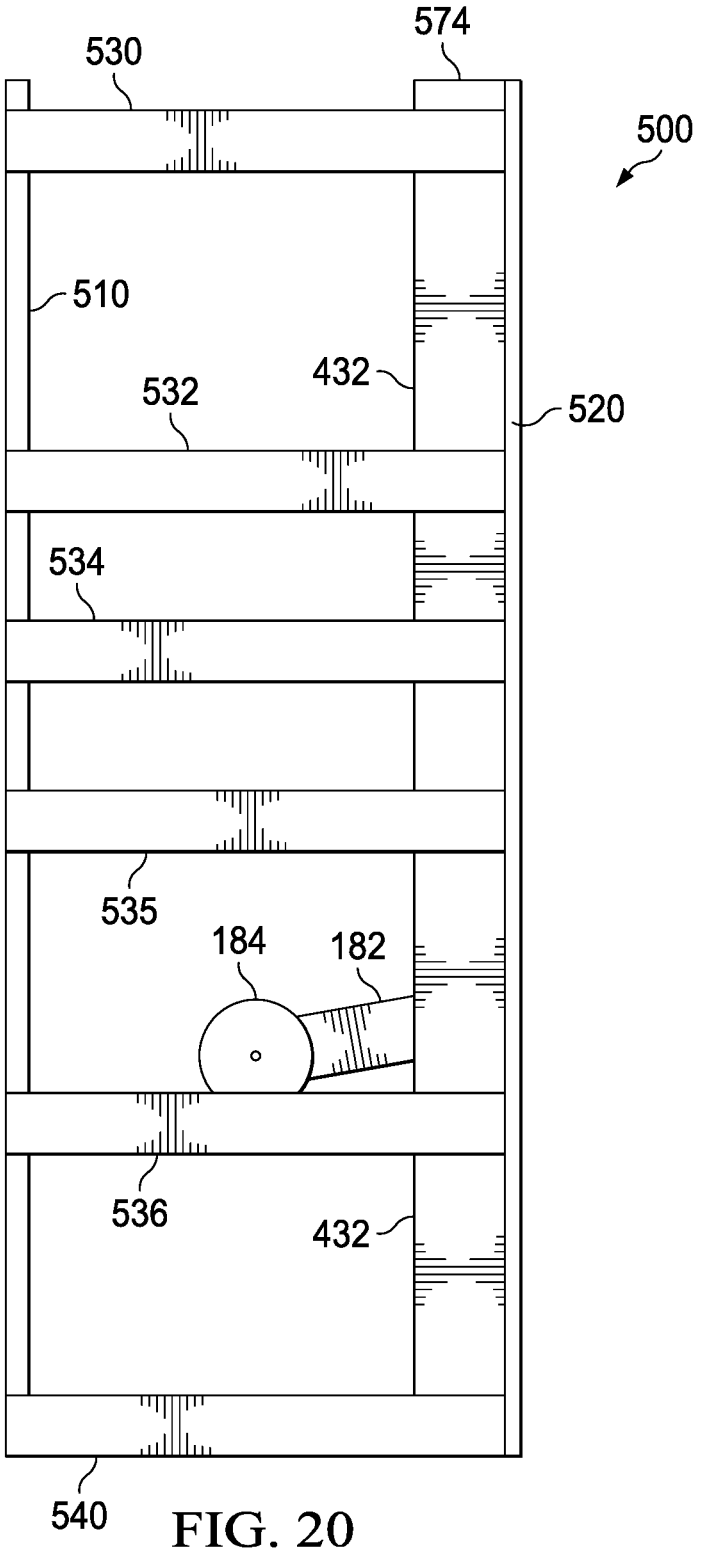
FIG. 20 illustrates a side plan view of the pre-framed collapsible gate of FIG. 18, with the collapsible gate in a fully open position.
Figure 21:
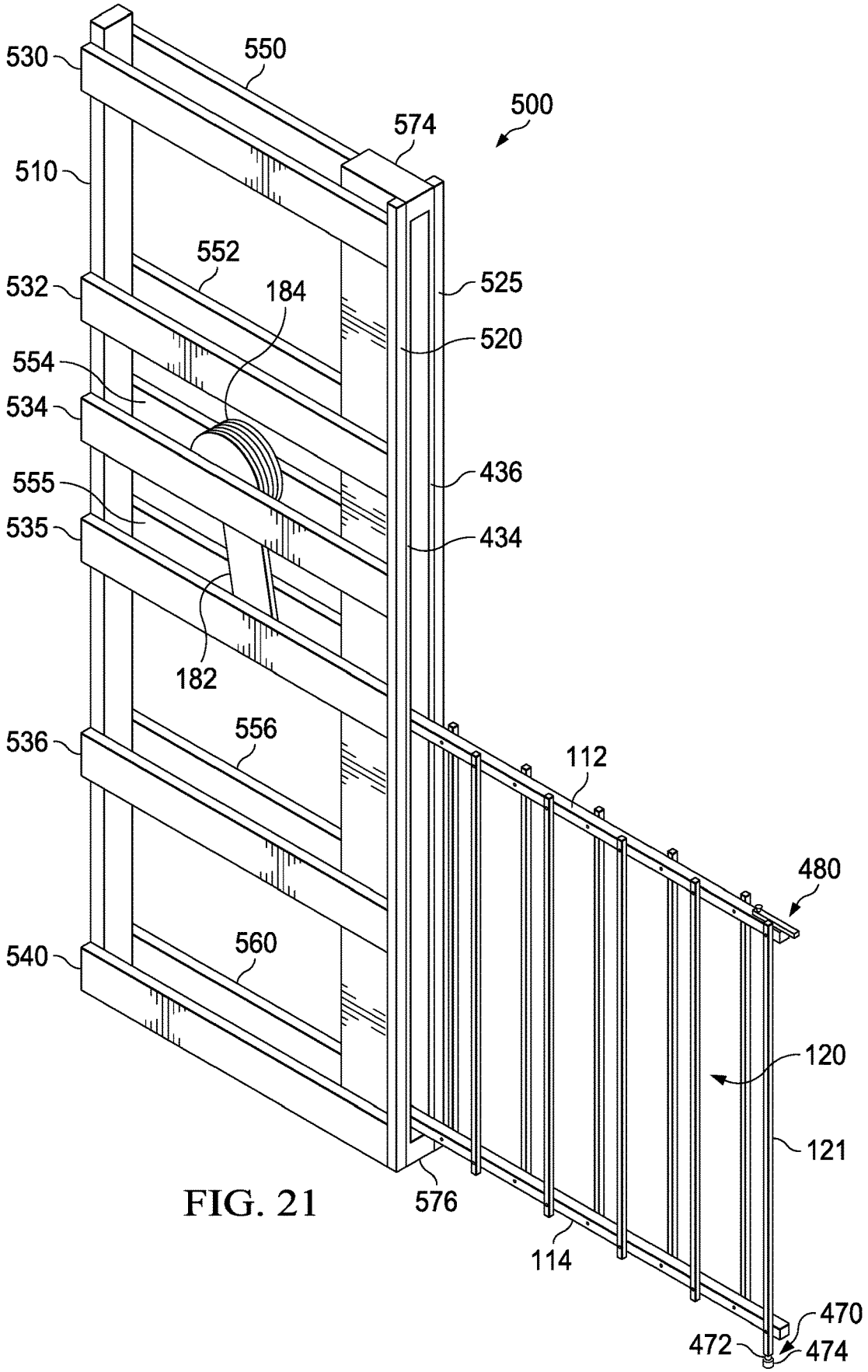
FIG. 21 illustrates a perspective view of the pre-framed collapsible gate of FIG. 18, with the collapsible gate in the closed position.
Figure 22:
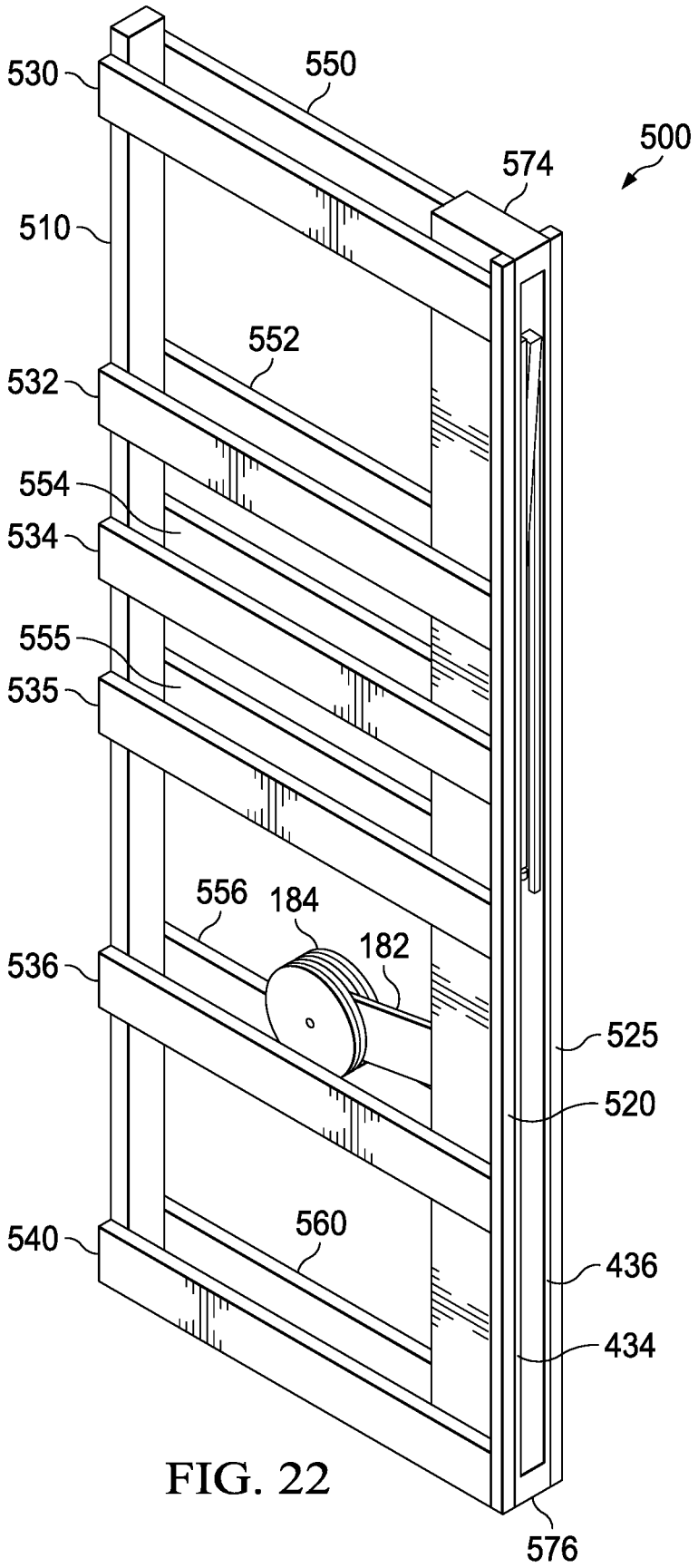
FIG. 22 illustrates a perspective view of the pre-framed collapsible gate of FIG. 18, with the collapsible gate in the open position.

FIG. 18 depicts a side plan view of the pre-framed collapsible gate 400 in the closed position, FIG. 19 depicts a side plan view of the pre-framed collapsible gate 400 in a partially open position, and FIG. 20 depicts a side plan view of the pre-framed collapsible gate 400 in a fully open position within the framing system 500. FIGS. 21 and 22 depict perspective views of the pre-framed collapsible gate 400 in the closed position and in the fully open position, respectively, within the framing system 500. Like reference numerals are used to indicate common features between collapsible gate 400 of FIGS. 18-22, collapsible gate 400 of FIGS. 14-17, and collapsible gate 100 of FIGS. 1-6.

As best shown in FIGS. 21 and 22, the framing system 500 may generally form an open rectangular box structure, although other shapes are contemplated by the present disclosure. In one implementation, the framing system 500 may include a back vertical support 510, a first forward vertical support 520, and a second forward vertical support 525. Disposed between and coupled to vertical supports 510, 520, the framing system 500 may further comprise a top horizontal support 530, a middle horizontal support 535, and a bottom horizontal support 540. Likewise, in mirrored fashion, disposed between and coupled to vertical supports 510, 525, the framing system 500 may further comprise a top horizontal support 550, a middle horizontal support 555, and a bottom horizontal support 560. One or more additional pairs of horizontal supports 532, 552; 534, 554 and 536, 556 may be provided between the top horizontal supports 530, 550 and the bottom horizontal supports 540, 560. Variations in the size, shape, number, and placement of vertical and horizontal supports forming the framing system are contemplated by the present disclosure.

As previously described, the collapsible gate 400 is operable to expand across a hallway or doorway to provide a temporary barrier that may be used, for example, to keep pets or children out of an area. The collapsible gate 400 may include a top rail 112, a bottom rail 114 and a plurality of barrier rails 120 extending there between. As best depicted in FIG. 21, the barrier rails 120 may be coupled to alternate sides of the top rail 112 and the bottom rail 114 in a staggered fashion to allow the gate 400 to collapse tightly in the open position.

The collapsible gate 400 may further comprise a support system including a mounting bracket 430 and an adjustable foot 470. The support system is adapted to couple the collapsible gate 400 to the framing system 500 for installation within a wall cavity, and the support system is adapted to support the weight of top rail 112, bottom rail 114 and barrier rails 120 during operation.

The support system may comprise a mounting bracket 430 including a U-shaped support section 432 with a first mounting flange 434, a second mounting flange 436, a top cap 574, and a bottom cap 576 coupled thereto. As best depicted in FIGS. 21 and 22, the first mounting flange 434 and the second mounting flange 436 may each extend outwardly from, and perpendicular to, the respective legs of the U-shaped support section 432. In an implementation, the U-shaped support section 432 of the mounting bracket 430 may have a unitary construction formed by bending a single steel plate to create the U-shaped support section 432, the first mounting flange 434, and the second mounting flange 436.

In operation, the U-shaped support section 432 fits into the framing system 500 between the front vertical supports 520, 525. The first mounting flange 434 and the second mounting flange 436 each engage the front vertical supports 520, 525, respectively. The mounting flanges 434, 436 may include a plurality of mounting holes 435, as shown in FIG. 14, to receive screws to mount the collapsible gate 400 to the front vertical supports 520, 525 of the framing system 500. Additional mounting holes (not depicted) may be provided in the sides of the U-shaped support section 432 to mount the collapsible gate 400 to one or more of the horizontal supports of the framing system 500. When the gate 400 is in the open position shown in FIGS. 20 and 22, the U-shaped support section 432 receives the top rail 112, bottom rail 114 and the barrier rails 120 of the gate 400 in its collapsed configuration.

The front vertical supports 520, 525 are of sufficient length to support the length of the mounting bracket 430. In one implementation, the top cap 574 of the mounting bracket 430 extends beyond the top of the front vertical supports 520, 535, and the bottom cap 576 of the mounting bracket 430 is substantially flush with the bottom of the front vertical supports 520, 525. In addition, the front vertical supports 520, 525 are spaced apart to engage the first mounting flange 434 and the second mounting flange 436, respectively, of the U-shaped support section 432.

As best shown in FIGS. 18 and 21, the support system of the collapsible gate 400 may further comprise an adjustable foot 470 that supports the bottom of the collapsible gate 400 against the floor of the home or commercial building when the gate 400 is in the closed position. In an implementation, the first barrier rail 121 is slightly longer than the other barrier rails 120. The first barrier rail 121 may include a threaded port at the bottom end thereof to receive a threaded bolt 472 with a stopper foot 474 that engages the floor.

In operation, the threaded bolt 472 may be turned with respect to the threaded port in the first barrier rail 121 to raise or lower the stopper foot 474. In this manner, the adjustable foot 470 enables adjustability to support the collapsible gate 400 and level the top rail 112 and the bottom rail 114 with respect to the floor. In an implementation, the adjustable foot 470 may be raised or lowered up to 1.5 inches to support and level the collapsible gate 400 with respect to all types of flooring, including concrete, tile, wood, carpet, etc.

The collapsible gate 400 may further comprise a locking system 480 designed to lock the gate 400 in the closed configuration shown in FIGS. 18 and 21. In an implementation, the locking system 480 may comprise a locking slide bolt designed to slide into engagement with an aperture in a wall opposite from the wall cavity to lock the gate 400, and then slide out of engagement with the aperture in the wall to unlock the gate 400.

Once the collapsible gate 400 secured to framing system 500 is installed, the collapsible gate 400 shown in FIGS. 18-22 operates in much the same manner as the collapsible gate 400 of FIGS. 14-17 and in much the same manner as the collapsible gate 100 of FIGS. 1-6. As such, the operational descriptions of FIGS. 7-13 apply to all implementations of collapsible gates 100, 400, including the pre-framed collapsible gate of FIGS. 18-22. In addition, although certain features have been described with respect to either the collapsible gate 100 or the collapsible gate 400, those features may be included within the other implementation of collapsible gate 100, 400. For example, collapsible gate 100 may include a locking system 480, an adjustable foot 470 and/or an adjustable stop system 490. Other modifications are contemplated by the present disclosure.

The collapsible gates 100, 400 may meet the Juvenile Product Manufacturers Association spacing requirements for overall height of the gate 100, 400 off the floor and spacing between the barrier rails 120. In an implementation, the overall height of the gate 100, 400 off the floor is approximately 38 inches and the barrier rails 120 are spaced approximately 2.7 inches apart.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A pre-framed collapsible gate, comprising:

a framing system adapted for installation in a wall, the framing system comprising:

a back vertical support;

a first forward vertical support;

a second forward vertical support;

a first horizontal support spanning between the back vertical support and the first forward vertical support; and a second horizontal support spanning between the back vertical support and the second forward vertical support;

a support system comprising a mounting bracket with a U-shaped support section, a first mounting flange, and a second mounting flange, wherein the U-shaped support section is disposed between the first forward vertical support and the second forward vertical support, the first mounting flange is coupled to the first forward vertical support, and the second mounting flange is coupled to the second forward vertical support, the support system adapted to secure a collapsible gate to the framing system before installation within the wall; and the collapsible gate comprising a rail system translatable between an open configuration wherein the collapsible gate is vertically retracted for storage within the framing system within the wall and a closed configuration wherein the collapsible gate is extended across a space to provide a temporary barrier;

wherein the rail system comprises:

a top rail;

a bottom rail; and a plurality of barrier rails pivotally coupled to the top rail and the bottom rail and extending there between; and wherein the plurality of barrier rails are spaced apart and coupled to alternate sides of the top rail and the bottom rail in a staggered fashion; and wherein the top rail, the bottom rail, and the plurality of barrier rails are stored within the U-shaped support section when the collapsible gate is in the open configuration.

2. The pre-framed collapsible gate of claim 1:

wherein the framing system is sized substantially similar to a pocket door frame.

3. The pre-framed collapsible gate of claim 1:

wherein the rail system is rotationally coupled to the support system to enable translation between the open configuration and the closed configuration.

4. The pre-framed collapsible gate of claim 1, further comprising:

a counterbalance coupled to the rail system.

5. The pre-framed collapsible gate of claim 1, wherein the support system comprises:

a foot adapted to support the bottom of the collapsible gate against a floor in the closed configuration;

wherein the foot is height adjustable to enable leveling of the rail system.

6. The pre-framed collapsible gate of claim 1, further comprising:

a lock system adapted to enable selective locking and unlocking of the gate in the closed configuration.

7. The pre-framed collapsible gate of claim 1:

wherein the framing system forms an open rectangular box structure.

8. A pre-framed collapsible gate comprising:

a framing system adapted for installation within a wall, the framing system comprising:

a first forward vertical support; and a second forward vertical support;

a support system comprising a mounting bracket with a U-shaped support section, a first mounting flange, and a second mounting flange, wherein the U-shaped support section is disposed between the first forward vertical support and the second forward vertical support, the first mounting flange is coupled to the first forward vertical support, and the second mounting flange is coupled to the second forward vertical support, the support system adapted to secure a collapsible gate at least partially within the framing system before installation within the wall;

the collapsible gate comprising a rail system translatable between an open configuration wherein the collapsible gate is vertically retracted for storage within the framing system within the wall and a closed configuration wherein the collapsible gate is extended across a space to provide a temporary barrier;

a counterbalance coupled to the rail system; and a foot coupled to the rail system and adapted to support the bottom of the collapsible gate against a floor in the closed configuration.

9. The pre-framed collapsible gate of claim 8:

wherein the foot is height adjustable to enable leveling of the rail system.

10. The pre-framed collapsible gate of claim 8, further comprising:

a lock system adapted to enable selective locking and unlocking of the gate in the closed configuration.

11. The pre-framed collapsible gate of claim 8:

wherein the framing system is sized substantially similar to a pocket door frame.

12. The pre-framed collapsible gate of claim 8, wherein the rail system comprises:

a top rail;

a bottom rail; and a plurality of barrier rails pivotally coupled to the top rail and the bottom rail and extending there between; and wherein the plurality of barrier rails are spaced apart and coupled to alternate sides of the top rail and the bottom rail in a staggered fashion.

13. The pre-framed collapsible gate of claim 12:

wherein the top rail, the bottom rail, and the plurality of barrier rails are stored within the U-shaped support section when the collapsible gate is in the open configuration.

14. The pre-framed collapsible gate of claim 8, wherein the framing system further comprising:

a back vertical support;

a first horizontal support spanning between the back vertical support and the first forward vertical support; and a second horizontal support spanning between the back vertical support and the second forward vertical support.

15. The pre-framed collapsible gate of claim 8:

wherein the framing system forms an open rectangular box structure.

16. A method of providing a temporary barrier comprising:

securing a collapsible gate to a framing system via a mounting bracket comprising:

a U-shaped support section disposed between a first vertical support of the framing system and a second vertical support of the framing system;

a first mounting flange coupled to the first vertical support; and a second mounting flange coupled to the second vertical support;

installing the framing system and the secured collapsible gate within a wall; and translating the collapsible gate between an open configuration wherein the collapsible gate is vertically retracted for storage within the framing system in the wall and a closed configuration wherein the collapsible gate is extended across a space to provide the temporary barrier;

wherein at least a portion of the collapsible gate is stored within the U-shaped support section of the mounting bracket when the collapsible gate is in the open configuration.

17. The method of claim 16, further comprising:

locking the collapsible gate in the closed configuration.

18. The method of claim 16, further comprising:

coupling the framing system to framing material within the wall after the installing step.

19. The method of claim 16, further comprising:

engaging a foot of the collapsible gate with a floor when the gate is in the closed configuration.

20. The method of claim 19, further comprising:

adjusting a height of the foot to level the collapsible gate with respect to the floor in the closed configuration.

* * * * *